US012338993B2

(12) United States Patent
Bahrami et al.

(10) Patent No.: US 12,338,993 B2
(45) Date of Patent: Jun. 24, 2025

(54) COMPACT FLAT PLATE PREMIX FUEL COMBUSTION SYSTEM, AND FLUID HEATING SYSTEM AND PACKAGED BURNER SYSTEM INCLUDING THE SAME

(71) Applicant: Fulton Group N.A., Inc., Pulaski, NY (US)

(72) Inventors: Alireza Bahrami, Manlius, NY (US); Carl Nicholas Nett, Sandisfield, MA (US)

(73) Assignee: FULTON GROUP N.A., INC., Pulaski, NY (US)

( * ) Notice: Subject to any disclaimer, the term of this patent is extended or adjusted under 35 U.S.C. 154(b) by 744 days.

(21) Appl. No.: 17/547,078

(22) Filed: Dec. 9, 2021

(65) Prior Publication Data

US 2022/0099291 A1 Mar. 31, 2022

Related U.S. Application Data

(63) Continuation-in-part of application No. 17/001,230, filed on Aug. 24, 2020, now Pat. No. 11,236,903, (Continued)

(51) Int. Cl.
*F23D 14/02* (2006.01)
*F23D 14/70* (2006.01)
*F23D 14/82* (2006.01)

(52) U.S. Cl.
CPC ..... *F23D 14/02* (2013.01); *F23D 14/70* (2013.01); *F23D 14/82* (2013.01); (Continued)

(58) Field of Classification Search
CPC ..... F23D 14/02; F23D 14/70; F23D 14/82; F23D 2203/1026; F23D 2207/00; F23D 2209/10
(Continued)

(56) References Cited

U.S. PATENT DOCUMENTS 3,439,996 A * 4/1969 Lherault ..... F23D 14/145 431/328
3,472,601 A * 10/1969 Kazuo ..... F23D 14/149 431/328
(Continued)

FOREIGN PATENT DOCUMENTS

CA 2565058 A1 2/2000
EP 1813864 A2 8/2007
(Continued)

OTHER PUBLICATIONS

International Search Report for corresponding PCT Application No. PCT/US2022/041354 dated Dec. 9, 2022.
(Continued)

*Primary Examiner* — Vivek K Shirsat
(74) *Attorney, Agent, or Firm* — McCormick, Paulding & Huber PLLC

(57) ABSTRACT

A burner combustion system comprising: a burner casing comprising a first inlet and a first outlet; a combustion substrate disposed in the burner casing, wherein the combustion substrate is porous, and wherein the burner casing first outlet is disposed on an exterior of the combustion substrate; an inlet conduit disposed in the burner casing, the conduit comprising a second inlet and second outlet, wherein the second inlet of the conduit is outside the burner casing, and, wherein the second outlet of the conduit is connected to the burner casing first inlet, and wherein the combustion substrate may have a flat shape and wherein the burner combustion system may further comprise a baffle.

28 Claims, 21 Drawing Sheets

Related U.S. Application Data which is a continuation-in-part of application No. 16/285,119, filed on Feb. 25, 2019, now Pat. No. 10,989,406, which is a continuation-in-part of application No. PCT/US2019/019441, filed on Feb. 25, 2019.

(60) Provisional application No. 63/236,969, filed on Aug. 25, 2021, provisional application No. 62/634,520, filed on Feb. 23, 2018, provisional application No. 62/634,476, filed on Feb. 23, 2018.

(52) U.S. Cl.
CPC .. *F23D 2203/1026* (2013.01); *F23D 2207/00* (2013.01); *F23D 2209/10* (2013.01)

(58) Field of Classification Search
USPC ..... 431/328
See application file for complete search history.

(56) References Cited

U.S. PATENT DOCUMENTS

| | | | | |
|---|---|---|---|---|
| 3,881,863 | A | 5/1975 | Creuz | |
| 4,202,660 | A * | 5/1980 | Pei | F28F 1/10 431/355 |
| 4,290,746 | A * | 9/1981 | Smith | F23D 14/16 431/328 |
| 4,439,996 | A * | 4/1984 | Frohbieter | F25B 5/04 62/502 |
| 4,673,349 | A | 6/1987 | Abe et al. | |
| 6,612,295 | B2 | 9/2003 | Lerner | |
| 11,236,903 | B2 * | 2/2022 | Nett | F23C 5/32 |
| 2006/0251998 | A1 | 11/2006 | Lamberts et al. | |
| 2006/0292510 | A1 * | 12/2006 | Krauklis | F23D 14/145 431/354 |
| 2007/0020575 | A1 | 1/2007 | Okayasu | |
| 2010/0077731 | A1 | 4/2010 | Jeong et al. | |
| 2013/0206759 | A1 | 8/2013 | Würz et al. | |
| 2013/0273485 | A1 | 10/2013 | Lenoir et al. | |
| 2016/0116160 | A1 | 4/2016 | Takeuchi | |

FOREIGN PATENT DOCUMENTS

| | | | |
|---|---|---|---|
| EP | 2713105 | A1 | 4/2014 |
| KR | 10-2005-001590 | A | 1/2005 |
| KR | 10-0568027 | B1 | 4/2006 |
| KR | 10-2011-0136802 | B1 | 12/2011 |
| KR | 10-2017-0075494 | A | 7/2017 |
| WO | 2017111430 | A1 | 6/2017 |
| WO | 2018215241 | A1 | 11/2018 |
| WO | 2019165385 | A1 | 8/2019 |

OTHER PUBLICATIONS

International Search Report for corresponding PCT Application No. PCT/US2019/019441 dated Jun. 19, 2019.

European Search Report for corresponding EP Application No. EP21192827 dated Jan. 13, 2022.

* cited by examiner

FIG. 10B
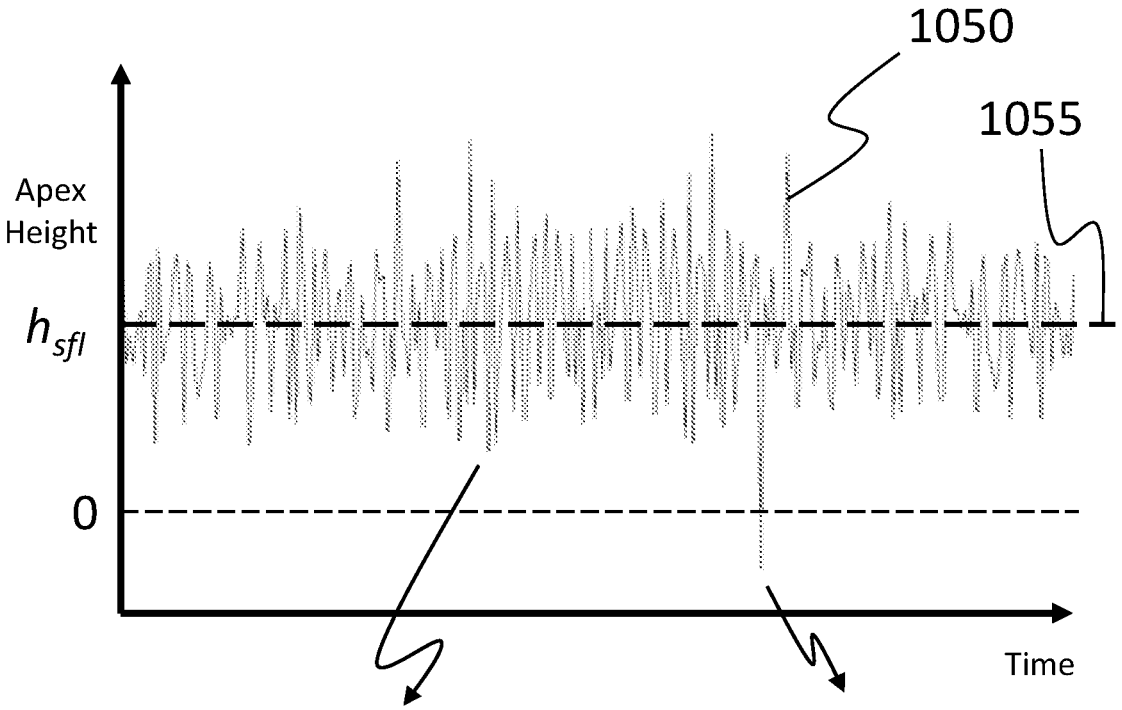
FIG. 10C
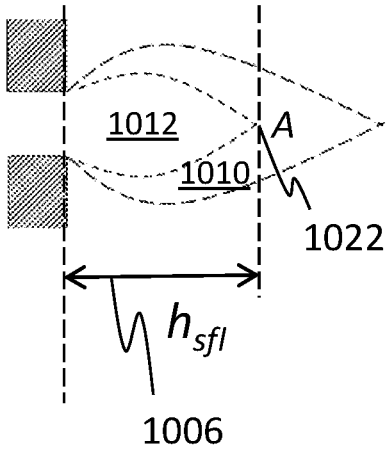
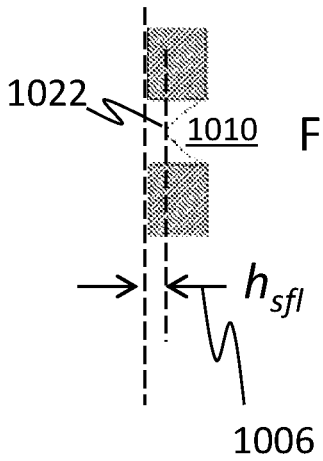
FIG. 10D

[1]Including (but not limited to) $O_2$ levels and metal temperatures

COMPACT FLAT PLATE PREMIX FUEL COMBUSTION SYSTEM, AND FLUID HEATING SYSTEM AND PACKAGED BURNER SYSTEM INCLUDING THE SAME

CROSS REFERENCE TO RELATED APPLICATIONS

This application claims priority to U.S. Provisional Patent Application Ser. No. 63/236,969, filed on Aug. 25, 2021, and is a continuation-in-part of U.S. patent application Ser. No. 17/001,230, filed on Aug. 24, 2020, which is a continuation-in-part of U.S. patent application Ser. No. 16/285,119, filed on Feb. 25, 2019, which claims priority to U.S. Provisional Patent Application Ser. No. 62/634,476, filed on Feb. 23, 2018 and U.S. Provisional Patent Application Ser. No. 62/634,520, filed on Feb. 23, 2018, and which is a continuation-in-part of PCT Patent Application Serial No. PCT/US2019/019441, filed on Feb. 25, 2019, which claims priority to U.S. Provisional Patent Application Ser. No. 62/634,520, filed on Feb. 23, 2018, the contents of each application cited above are incorporated herein by reference in their entirety to the extent permissible by applicable law.

BACKGROUND

(1) Field

This application relates to a compact premix fuel combustion system, methods of manufacture thereof, methods of using a premix fuel combustion system, and methods of fluid heating incorporating a compact premix fuel combustion system.

(2) Description of the Related Art

Premix fuel combustion systems are used to provide a heated thermal transfer fluid for a variety of commercial, industrial, and domestic applications such as hydronic, steam, and thermal fluid boilers, for example. Because of the desire for improved energy efficiency, compactness, reliability, and cost reduction, there remains a need for improved premix fuel combustion systems, as well as improved methods of manufacture thereof.

Incomplete combustion and large temperature gradients, which results in a decrease in overall system performance, is present through a variety of pathways in combustion systems. This is particularly true of combustion systems incorporated into fluid heating systems for production of hot water, steam, and thermal fluid for hot liquid or steam for ambient temperature regulation, hot water consumption, or commercial and industrial process applications. Moreover, residential, commercial, industrial and government uses of combustion systems for a variety of applications benefit from improvements that decrease the size, volume and footprint of these apparatuses, particularly those that utilize premix fuel and air (oxygen) combinations. Thus, there remains a need for an improved compact premix fuel combustion system having improved thermal efficiency.

SUMMARY

Disclosed herein is a premix burner combustion system with a flat plate combustion substrate.

Also disclosed is a premix burner combustion system with a flat plate combustion substrate and a baffle for directing the fuel-air mixture.

The above described and other features are exemplified by the following figures and detailed description.

BRIEF DESCRIPTION OF THE DRAWINGS

Referring to the figures, which are exemplary embodiments, and wherein the like elements are numbered alike.

FIG. 10B illustrates the time variation of the apex of the combustion transition region around a time-average setpoint in accordance with embodiments of the present disclosure.

FIG. 10C illustrates the typical flamelet geometry attached to the combustion substrate and extending into the interior of the furnace chamber in accordance with embodiments of the present disclosure.

FIG. 10D illustrates the typical flamelet geometry attached to the combustion substrate and extending into the interior of the combustion substrate pore in accordance with embodiments of the present disclosure.

DETAILED DESCRIPTION

Figure 1:
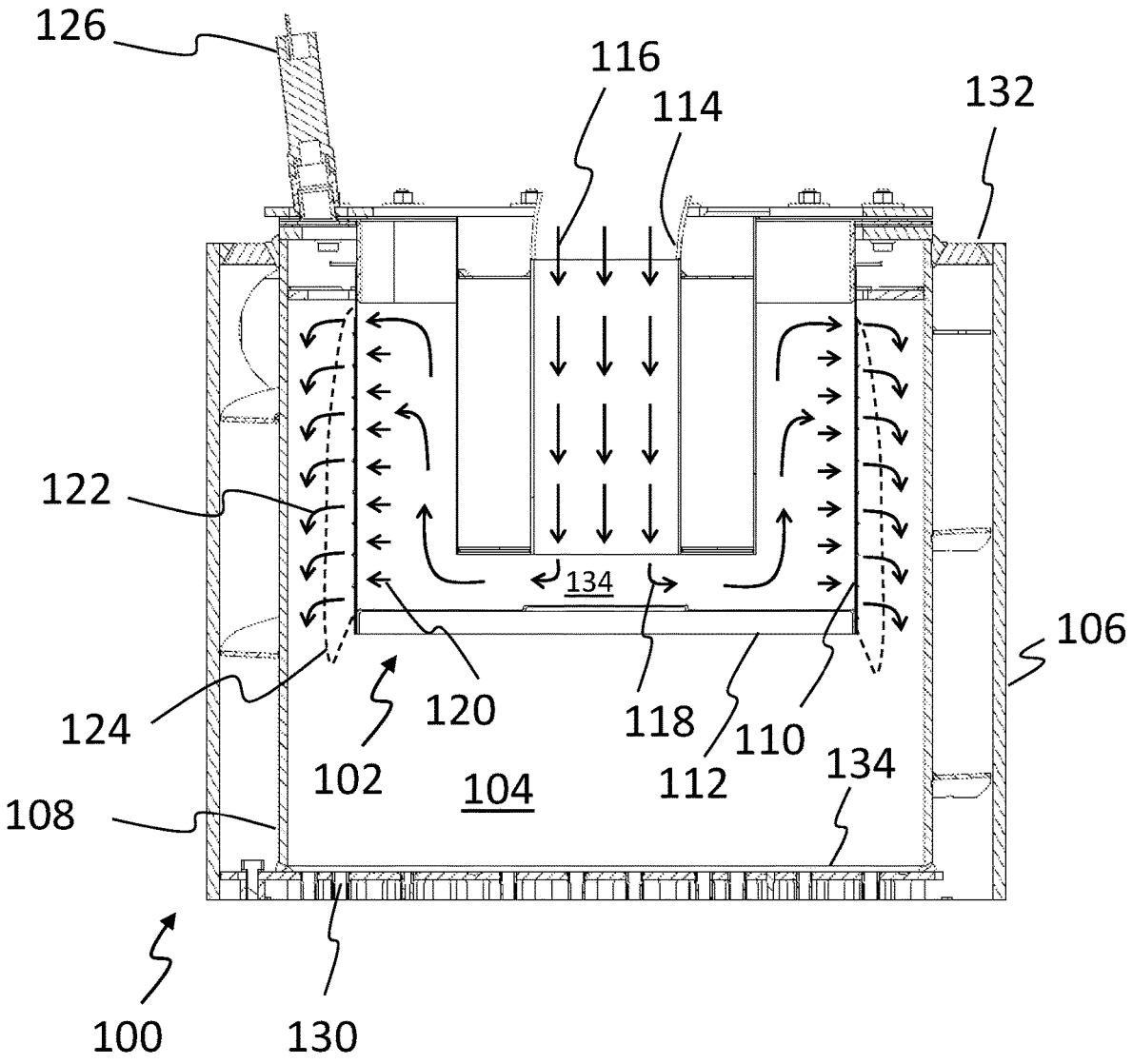
FIG. 1 shows a cross-sectional diagram of a burner with permeable walls contained within a furnace in accordance with embodiments of the present disclosure.

As further discussed herein, the Applicants have discovered that combustion systems can suffer incomplete combustion due to the small and constrained combustion volume available, large temperature gradients that can result in material and performance failures, and undesirable flow characteristics of the hot combustion gases and products can be produced in the apparatus.

Moreover, combustion systems can exhibit an undesirable instability called flashback (alternatively, blowback) wherein the combustion region can traverse the combustion substrate and convect upstream towards the fuel source creating hazardous operating conditions. Methods known in the industry avoid this instability using large design, manufacturing and operating margins at the expense of cost and operating efficiencies.

Disclosed is an improved premix fuel combustion system for applications that require heat generation which provides improved efficiency, apparatus lifecycle and performance by alleviating or eliminating these disadvantages.

A burner is a combustion system designed to provide thermal energy through a combustion process to apparatuses used for a variety of applications. The burner may include, depending upon the fuel, combustion geometry and target application, a burner head that supports the combustion process, one or a plurality of nozzles or orifices, air blower with damper, burner control system, shut-off devices, fuel regulator, air and fuel filters, fuel pressure switches, air pressure switches, flame detector, ignition devices, air damper and fuel valves and fittings. Typical burner systems range in capacity from 30 kW to 1,500 kW (approximately 3 boiler horsepower (BHP) to 153 BHP) and can be adapted to a wide range of uses including incinerators, boilers, drying systems, industrial ovens, and furnaces.

A package burner is a burner combustion system designed to be incorporated as a standalone modular subsystem unit into apparatuses used for a variety of applications. The package burner may include, depending upon the fuel, combustion geometry and target application, an integrated subsystem comprising a burner head that supports the combustion process, one or a plurality of nozzles or orifices, air blower with damper, burner control system, shut-off devices, fuel regulator, air and fuel filters, fuel pressure switches, air pressure switches, flame detector, ignition devices, air damper and fuel valves and fittings. Typical package burner systems range in capacity from 30 kW to 1,500 kW (approximately 3 boiler horsepower (BHP) to 153 BHP) and can be adapted to a wide range of uses including incinerators, boilers, drying systems, industrial ovens & furnaces.

In the discussion that follows, we use several combustion mechanism terms. Volume combustion occurs where a fuel-air mixture is ignited in a spatial volume. A physical structure may contain the combustion process, such as in a cavity burner, but the details of the structure do not directly participate in the thermodynamic combustion process. In surface combustion, the combustion process occurs directly upon—or at a very small distance from—a burner combustion surface. The physical, geometrical and material characteristics of the surface contribute to determining the thermodynamic physics. If the fuel-air mass flow is reduced below a threshold, the flame front can approach the substrate and enter a regime of surface combustion creating a risk of flashback that could ignite the fuel-air mixture upstream of the burner combustion substrate and, in the extreme case, possibly causing uncontrolled explosive combustion.

A boiler is a fluid heating system incorporating a heat exchanger that may be used to exchange heat between any suitable fluids, e.g., a first fluid and a second fluid, wherein the first and second fluids may each independently be a gas or a liquid. In the disclosed system, the first fluid, which is directed through the heat exchanger core, is a thermal transfer fluid, and may be a combustion gas, e.g., a gas produced by fuel fired combustor, and may comprise water, carbon monoxide, nitrogen, oxygen, carbon dioxide, combustion byproducts or combination thereof. The thermal transfer fluid may be a product of combustion from a hydrocarbon fuel such as natural gas, propane, or diesel, for example.

Also, the second fluid, which is directed through the pressure vessel and contacts an entire outer surface of the heat exchanger core, is a production fluid and may comprise water, steam, oil, a thermal fluid (e.g., a thermal oil), or combination thereof. The thermal fluid may comprise water, a C2 to C30 glycol such as ethylene glycol, a unsubstituted or substituted C1 to C30 hydrocarbon such as mineral oil or a halogenated C1 to C30 hydrocarbon wherein the halogenated hydrocarbon may optionally be further substituted, a molten salt such as a molten salt comprising potassium nitrate, sodium nitrate, lithium nitrate, or a combination thereof, a silicone, or a combination thereof. Representative halogenated hydrocarbons include 1,1,1,2-tetrafluoroethane, pentafluoroethane, difluoroethane, 1,3,3,3-tetrafluoropropene, and 2,3,3,3-tetrafluoropropene, e.g., chlorofluorocarbons (CFCs) such as a halogenated fluorocarbon (HFC), a halogenated chlorofluorocarbon (HCFC), a perfluorocarbon (PFC), or a combination thereof. The hydrocarbon may be a substituted or unsubstituted aliphatic hydrocarbon, a substituted or unsubstituted alicyclic hydrocarbon, or a combination thereof. Commercially available examples include Therminol® VP-1, (Solutia Inc.), Diphyl® DT (Bayer A. G.), Dowtherm® A (Dow Chemical) and Therm® S300 (Nippon Steel). The thermal fluid can be formulated from an alkaline organic compound, an inorganic compound, or a combination thereof. Also, the thermal fluid may be used in a diluted form, for example with a concentration ranging from 3 weight percent to 10 weight percent, wherein the concentration is determined based on a weight percent of the non-water contents of the thermal transfer fluid in a total content of the thermal transfer fluid.

An embodiment in which the thermal transfer fluid comprises predominately gaseous products from combustion of natural gas or propane, and further comprises liquid water, steam, or a combination thereof and the production fluid comprises liquid water, steam, a thermal fluid, or a combination thereof is specifically mentioned.

FIG. 1 shows a cross-sectional schematic of an embodiment of an outward-firing premix burner 102 contained within the combustion chamber of a furnace 104. A premixed combination of predominately vapor fuel and air 116 enters the burner inlet 114. In this embodiment the burner has the geometry of a cylindrical annulus, closed at the end distal from the inlet 112. The outer cylindrical combustion substrate 110 is porous and permits the flow of the premixed fuel-air combination. The fuel-air mixture is directed 118 outward along the inner face of the burner cap 112 to the inner region 120 behind the porous outer burner combustion substrate 110. The premix fuel-air combination passes through the pores in the burner combustion substrate 110 and is ignited to form a dense composite region of flame 124, the flame front hovering over the cylindrical burner combustion substrate by the mass flow 122 of the fuel-air mixture emanating through each of the substrate pores. The resulting flame is typically monitored using a sensor 126 that can detect when the flame is extinguished and/or used as an element in a control system to, for example, modulate the flow rate and/or concentrations of the premix fuel-air mixture.

In a shell-and-tube boiler heat exchanger application, the hot combustion products flow into the body of the furnace 108 where they pass through the heat exchanger tubesheet 104 and into the heat exchanger tubes 130. Thermal energy generated by combustion of the premix fuel-air mixture in the region of the composite flame 124 is transferred across the thin walls of the heat exchanger tubes 130 to the production fluid inside the pressure vessel 106 sealed at one end to the furnace by the top head 132.

One disadvantage to the outward firing geometry is that the composite flame region 124 and hot combustion products 122 can impinge upon the inner surface of the furnace 108, depending upon the fuel-air mass flow through the pores, the dimensions of the space between the burner combustion substrate 110 and the inner furnace wall 108. Furthermore, the geometry of outward firing burners removes a substantial volume from the furnace cavity, reducing the volume available for combustion. As a result of the reduced volume, incomplete combustion occurs which lowers efficiency and increases the production of incomplete combustion products, including environmental contaminates. Additionally, the flow of hot combustion products must be reoriented to efficiently enter the heat exchanger; for example, the heat exchanger tubes 130 in the shown embodiment. This can cause a non-uniform temperature distribution across the tubesheet 134 and increased flow resistance requiring higher blower pressure and pressure drop across the burner/heat exchanger subsystems to overcome the flow resistance.

The combustion substrate 110 can be constructed using a variety of materials. Typically, in practice substrate construction using woven metal (e.g., steel) fabric or mesh is common. However, there are examples of combustion substrates that use solid structures perforated with openings to permit the flow of premix fuel-air mixture into the furnace for combustion heat production. Known examples of solid perforated combustion substrates are fabricated from thin (approximately 0.5 millimeter) metal sheet perforated with holes using a punch, stamp or perforation manufacturing process and then pressed into a final geometry; for example, a tube or cylinder. The use of thin metal sheet or sheet metal for the substrate material enables the use of relatively inexpensive manufacturing methods to bend and perforate the substrate into its final geometry. Examples of these types of solid substrates include the Furipat® and Multipat® cylindrical burners by Bekaert Combustion Technology (https://heating.bekaert.com/en/burners/furipat), the Bluejet™ burner by Sermeta, and the PREMIX burner by Polidoro USA Inc. In addition, European patent EP2037175A2 describes a cylindrical burner with thin metal combustion substrate.

Figure 2:
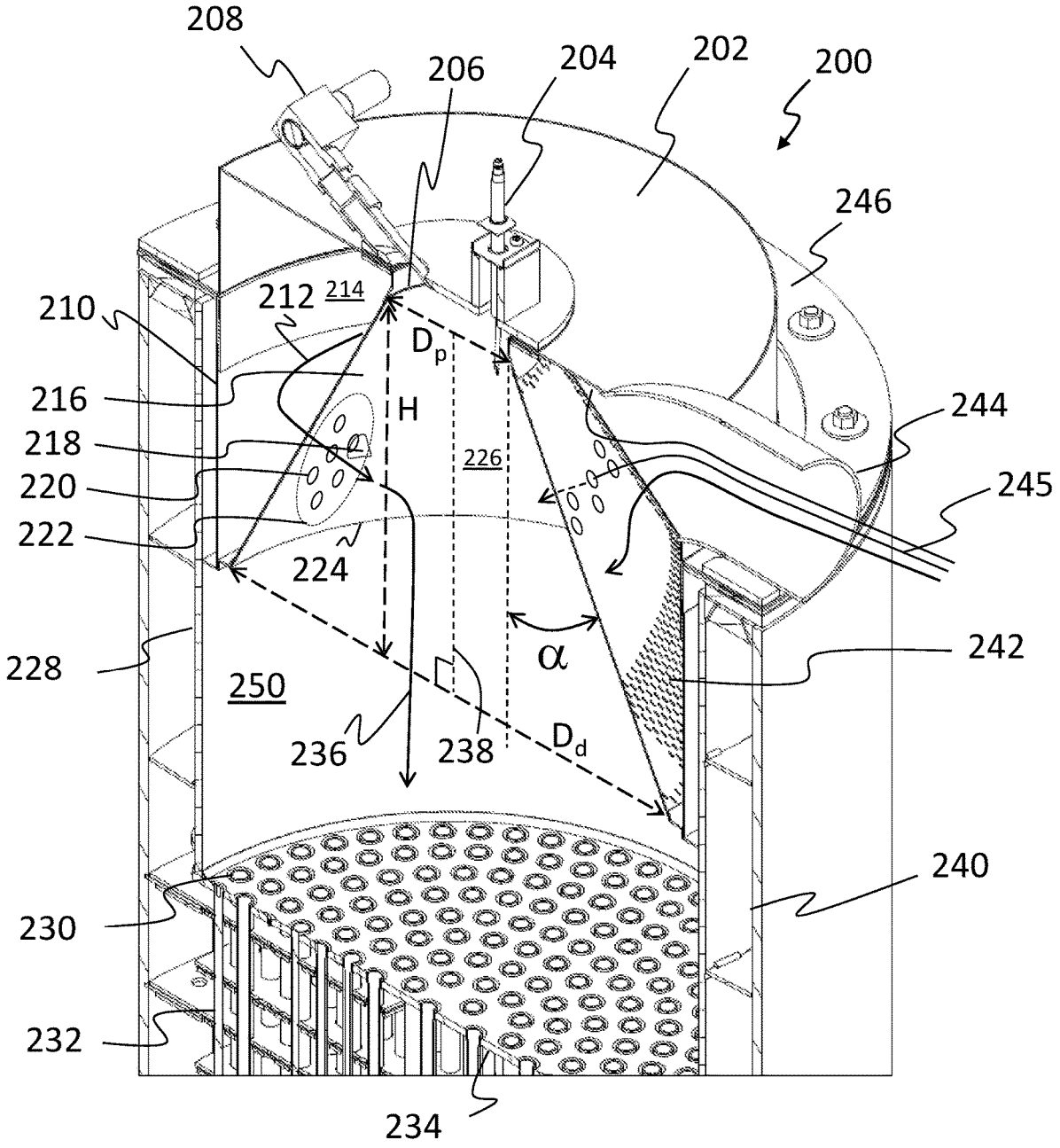
FIG. 2 shows a cutaway diagram of an embodiment of a premix combustion system with a single semi-conical combustion substrate in accordance with embodiments of the present disclosure.

The Applicants have unexpectedly discovered that a burner geometry using a solid combustion substrate can be exploited to alleviate many of the known disadvantages of using mesh or thin metal structures. FIG. 2 shows a cutaway diagram of an embodiment of an inward-firing premix burner comprising a semi-cone combustion substrate as previously described.

The burner combustion substrate is porous to the flow of premix fuel-air mixtures predominately in a vapor state. Substrate pores 242 are distributed over the area of the burner combustion substrate to support a flame front 218 near the interior surface. (The pore 220 size in a local area 222 are exaggerated in the diagram for clarity and are not meant to be to scale.) The combustion process may be monitored by a sensor 208 which can detect if the flame is extinguished.

In the embodiment shown a premix(ed) fuel-air mixture 245 enters the inlet 244 of the burner and flows 212 around and through the burner combustion substrate inward toward the axis 238. The fuel-air mixture ratio is arranged so that the premix fuel is ignited near the interior surface to form a flame 218 suspended over the interior surface of the burner combustion substrate.

In a boiler application comprising a shell and tube heat exchanger, the combustion products (e.g., hot gases, particulate byproducts) flow 236 towards the tubesheet 234 where they pass through the openings 230 of the heat exchanger tubes 232. Heat generated by the combustion process is transferred across the walls of the heat exchanger tubes 232 to production fluid occupying the space between the outer surfaces of the furnace 228 and heat exchanger tubes 232 and the inner surface of the pressure vessel 240, sealed at one end by the boiler top head 246.

The semi-cone combustion substrate 242 provides an effective means for increasing the surface area for combustion loading (amount of combustion that can be supported per square area of substrate surface) and maintain a very compact combustion volume (high power density). In addition, the flow field that emerges from the burner combustion cavity is radially oriented by design to efficiently enter the heat exchanger (shown as the tubesheet 234 and heat exchanger tubes 232 in the displayed embodiment), thereby reducing the flow resistance and resulting pressure drop across the burner/heat exchanger assembly. Moreover, the uniform flow field promotes a uniform temperature distribution across the inlet to the heat exchanger (e.g., in FIG. 2, the tubesheet 234 and collection of heat exchanger tube inlets 230).

Also, the burner assembly 200 and burner combustion cavity 226 do not occupy space in the furnace combustion cavity 250, providing ample space for complete combustion and resulting in reduced unburnt particulate byproducts and undesirable emissions (e.g., nitrogen oxide, NOx).

The Applicants have surprisingly discovered that the solid substrate with pore perforations as shown in the embodiment illustrated by FIG. 2 enable a very high combustion loading compared with other design alternatives. For example, for combustion systems comprising a mesh combustion surface, combustion loads of 300-400 watts per square centimeter ($W/cm^2$) are typical. Such systems also suffer from issues with mesh attachment to the support structures, porous surface clogging and material failure due to non-uniform temperature and flow distributions. Burner lifecycle limitations due to porous clogging typically requires use of filtered air in the premix fuel-air mixture, which increases the system maintenance requirements and can result in burner capacity reduction and failure.

A solid perforated substrate does not suffer these weaknesses. A solid perforated combustion substrate can sustain a significantly higher combustion loading: 1,200 $W/cm^2$ or more under typical operating conditions has been verified. Since the surface area of a semicone burner substrate like that illustrated by the embodiment shown in FIG. 2 can support such combustion loading, the cone geometry and combustion loading capabilities provide for a significant improvement in the range of burner requirements that can be accommodated and still remain compact subsystems, from small, low heat capacity burner to very large, very high heat capacity combustion systems.

The geometry requirements are determined by the design parameters of the burner and boiler systems, including the volume and dimensions of the furnace. For example, for the embodiment shown in FIG. 2, the diameter, $D_d$, of the burner is naturally limited by the overall diameter of the furnace interior wall 228. The Applicants have discovered that, for some combinations of burner heat requirements and furnace dimensions, the semicone combustion substrate height, H, can be set equal to zero and the resulting combustion substrate still has sufficient area to support the combustion loading required to achieve the burner design objectives. That is, the resulting semicone combustion substrate design requirements can be achieved by a semicone of height equal to zero, the shape being a flat substrate (equivalently, a "flat plate" or "plate" substrate). The flat substrate simply represents the geometrical limit of a family of semicone substrates with a fixed base diameter, $D_d$, and decreasing semicone height, H, and usable combustion surface area. Since the flat substrate has sufficient surface area using the enhanced combustion loading achievable with a solid porous substrate design, no further geometric complexity is required for some burner design demands.

Figure 3:
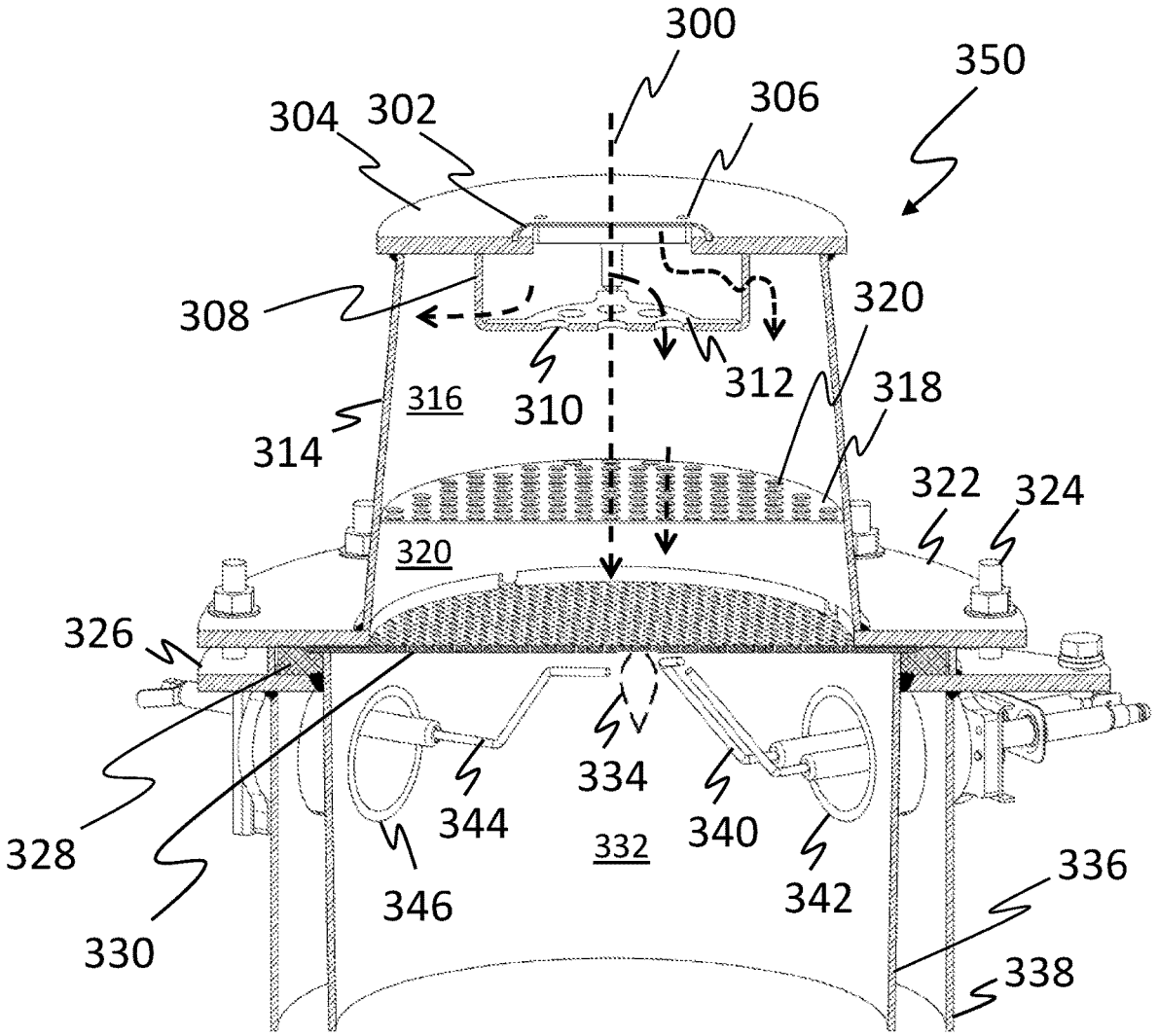
FIG. 3 shows a cross-sectional diagram of an embodiment of a premix combustion system with a flat plate combustion substrate in accordance with embodiments of the present disclosure.

FIG. 3 illustrates an embodiment comprising a flat substrate that achieves these special requirements. The burner subsystem 350 is disposed on the furnace flange 326 (alternatively, boiler top head ring), shown here using burner mounting bolts 324 through the burner flange 322 that secures the burner enclosure wall 314 and burner cap 304 to form the burner chamber 316. The burner flange 322 is sealed to the furnace flange or boiler top head ring 326 by a flexible gasket 328. The burner cap 304 comprises a blower opening 302 for premix to flow from the blower (not shown) into the burner chamber 316. In this embodiment, the blower may be disposed on the burner cap 304 using blower mounting bolts 306 that align the blower with the blower opening 302.

Under circumstances where the blower opening 302 is smaller than the diameter of the burner enclosure wall 314 and the combustion substrate 330 diameter, a distribution baffle 312 can be used to distribute the flow throughout the burner chamber 316. The distribution baffle 312 comprises a perforated plate with pores 310, the plate suspended from the burner cap 304 or burner enclosure wall 314 by one or more distribution baffle supports 308.

Since flow into the burner chamber 316 through the blower opening 302 and the distribution baffle 312 is turbulent and the design objective is to orient the premix flow 300 to be uniformly distributed and axially oriented across the combustion substrate 330, a flow straightener 318, a perforated baffle plate with aligning pores 320, may be disposed in the burner chamber 316 to create a region of uniformly distributed, axial flow in the premix axial flow chamber 320. Another feature of the distribution baffle is that it can serve as a flashback shield in the event that combustion traverses from the furnace cavity 332 into the burner chamber 316 or burner axial flow chamber 320.

The premix fuel-air mixture flows 300 through the blower opening 302, through the distribution baffle 312 into the burner chamber 316 where the flow straightener 318 orients the flow 300 axially and uniformly across the outer surface of the combustion substrate 330.

The premix flow distributed axially and uniformly across the surface of the perforated combustion substrate 330 flow through the substrate pores into the furnace combustion chamber 332 forming flamelets 334 attached to the combustion substrate 330 in a time-average sense. The furnace comprises an inner furnace wall 336 disposed inside a pressure vessel 338 sealed at one end by the boiler top head ring or furnace flange 326. Combustion can be initiated using an igniter comprising igniter electrodes 340 that enters the furnace combustion chamber 332 through the igniter opening 342. The presence of flamelets can be monitored using the flame rod 344 that enters the furnace combustion chamber 332 through the flame rod opening 346.

Figure 4:
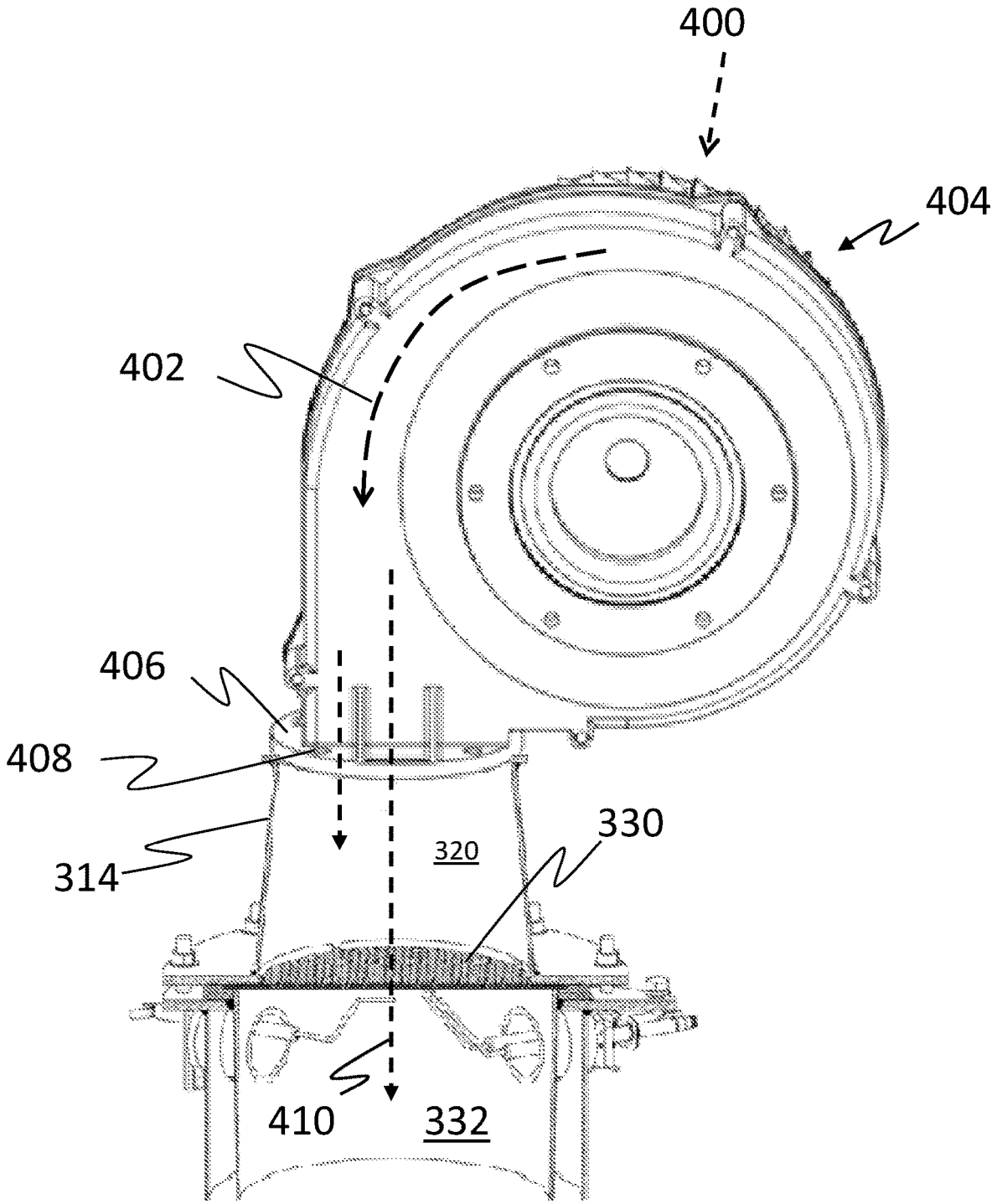
FIG. 4 shows a cross-sectional diagram of an embodiment of a premix combustion system with a flat plate combustion substrate wherein the outlet aperture of the blower is approximately the same size as the burner inlet opening in accordance with embodiments of the present disclosure.

FIG. 4 illustrates an embodiment where the blower opening and blower fan 406 are approximately the same size as the diameter of the burner enclosure wall 314. In this case, the air that enters the blower 404, mixed with fuel and driven under pressure 402 by the blower is nearly laminar and enters the burner chamber 320 nearly axially 410 with uniform distribution across the combustion substrate 330. In this case one skilled in the art may omit the inclusion of a distribution baffle 312 and/or a flow straightener 318 shown in FIG. 3.

The premix fuel-air mixture is typically provided to the inlet of the burner under pressure by a prime mover (equivalently, "blower" or "fan"). The key functional characteristics of the blower may be described in terms of four measurable quantities: the blower pressure, volumetric flow rate, absorbed power and the efficiency of energy conversion. The blower efficiency can be further separated into the fan efficiency (efficiency converting electrical power into fan power) and the combustion system efficiency (conversion of fuel stored energy into heat energy). As the premix fuel-air mixture is forced through the burner, the flow resistance imposes a pressure drop between the burner inlet and the furnace outlet.

Since the blower is the sole apparatus responsible for generating positive flow pressure as it enters the combustion system, it produces the driving forces responsible for the pressure and volumetric mass flow entering a heat exchanger after the pressure drop incurred by the combustion system. Furthermore, an important system design parameter is the electrical power utilized by the prime mover, where the user requirements typically limit the acceptable current and voltage consumption during installed operation.

Fluid heating system design conventions have limited fan design options that produce relatively low fan pressures, characterized by low electrical efficiencies. Consequently, fluid heating system in practice have been limited to the use of heat transfer assemblies (assemblies that may include typical components such as a burner, furnace, heat exchanger, exhaust manifold and flue piping) with a pressure drop to about 3,500 Pascals (Pa) or less and use blowers that create fan pressure of typically 0.5 pounds per square inch (psi) or less, and in all cases strictly less than 0.7 psi, above ambient pressure. As a result, current industry products utilize small, low-pressure blower fans to drive the thermal transfer fluid through heat transfer assemblies characterized by low inlet-to-outlet pressure drops, and adjust the geometry of the burner, furnace and heat exchanger to achieve a desired heat transfer rate.

Recent advances in efficient electric motor technologies and sophisticated fan blade geometries have resulted in the advent of efficient high pressure fan options heretofore unavailable to the industrial and commercial fluid heating system designer. For example, centrifugal fan designs capable of high tip speed, high flow turning operation which—when used in conjunction with efficient electrical motor technologies—can produce fan designs capable of high-pressure, high volumetric flow rate, energy-efficient operation.

For example, high-efficiency, high-pressure fans have become cost-effective that produce static pressures of 6,000 to 12,000 Pa operating at tip rotational speeds of 5,000 RPM to 11,000 RPM. In comparison, static pressures for conventional fan technologies would typically be in the range of 1,500 Pa to 2,500 Pa. The higher static pressures available from high-pressure, high-efficiency fan technologies results in a substantial expansion of possible combustion system configurations, since the much higher pressures can be utilized to overcome higher pressure drops and increase gas flow velocities through the combustion system. Efficiencies for conventional fan technologies would typically be 15% or more less than those expected for a high-pressure, high-efficiency fan embodiment.

Figure 5:
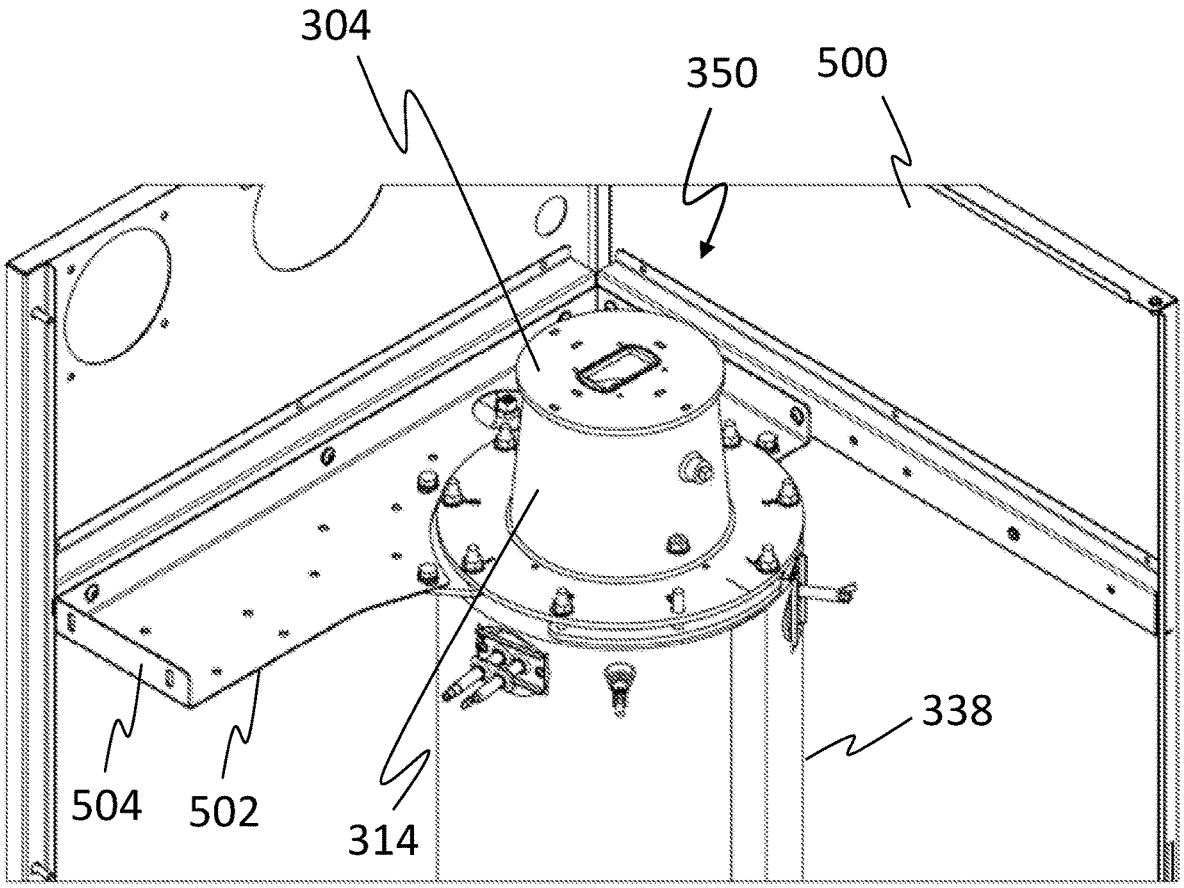
FIG. 5 shows a perspective drawing of an embodiment of a burner, including the burner cap and burner wall, disposed on the furnace flange in accordance with embodiments of the present disclosure.

FIG. 5 illustrate an embodiment where the burner 350 is disposed on the pressure vessel 338 supported, in this embodiment, by mounting brackets 502 which may be affixed, say using a flange 504 and mounting bolts, to a boiler case 500.

Figure 6:
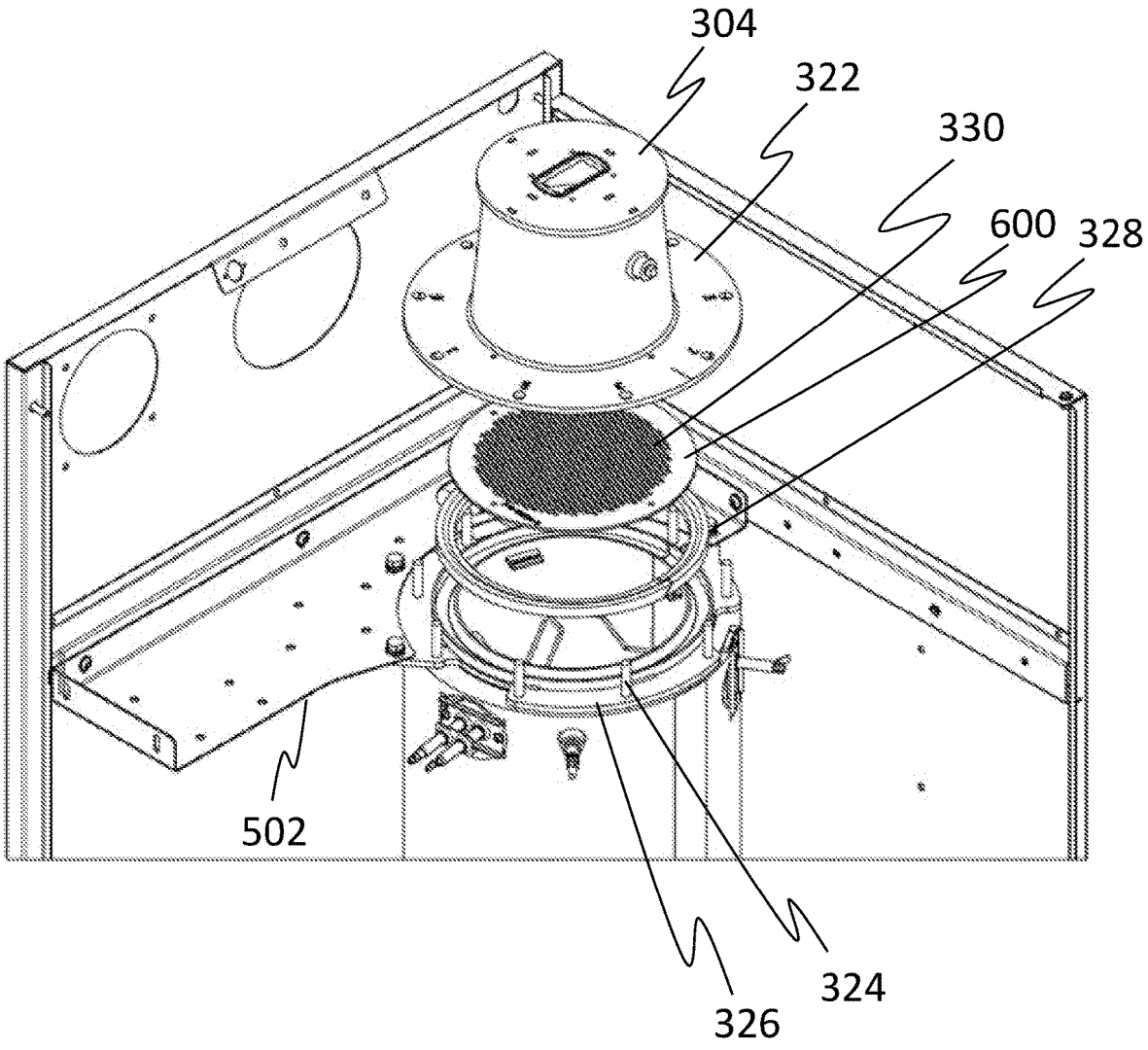
FIG. 6 shows a perspective view of some components comprising the burner of an embodiment of a premix combustion system with a flat plate combustion substrate in accordance with embodiments of the present disclosure.

FIG. 6 shows an embodiment that illustrates a combustion substrate 330 comprising a perforated region and an unperforated substrate flange 600 that is sandwiched between the burner flange 322 and the furnace flange or boiler top head ring 326 and sealed by a gasket 328. The assembly may be affixed using mounting bolts 324 to secure the assembly to the furnace flange 326.

Figure 7:
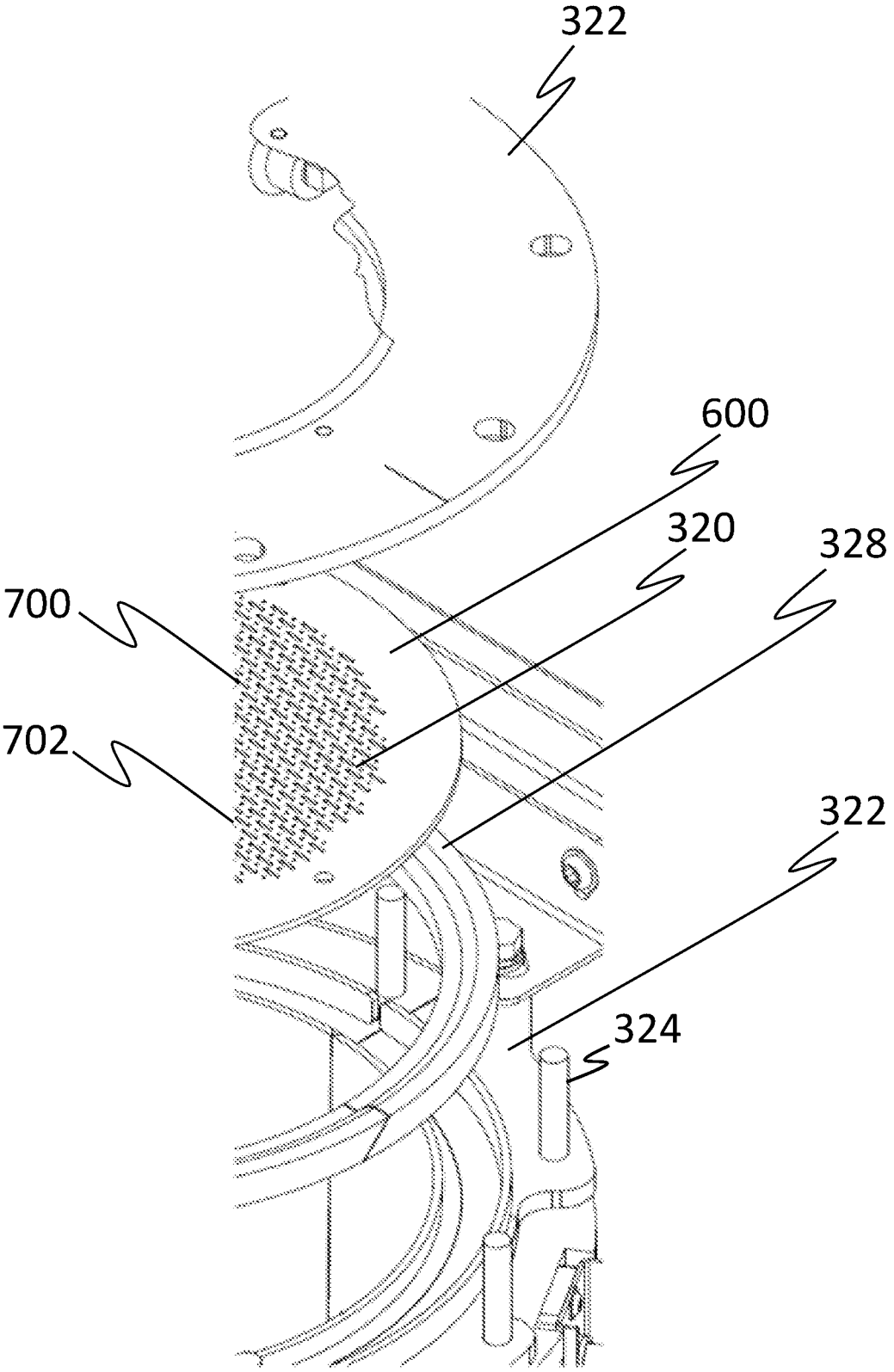
FIG. 7 shows a perspective view of the details of some components comprising the burner of an embodiment of a premix combustion system with a flat plate combustion substrate in accordance with embodiments of the present disclosure.

FIG. 7 illustrates that if the holes in the burner flange 322 and furnace flange 326 are oversized, the combustion substrate 330 can expand and contract under thermal changes without causing thermal material stress leading to material failure. The embodiment illustrates a serviceable combustion substrate assembly that mitigates the potential for material stress and failure due to thermal cycling.

FIG. 7 also shows that the perforated region of the combustion substrate 320 may be populated with pores of various shapes and sizes in combination, including circular pores 702 and elongated slots 700. Moreover, the combustion substrate flange 600 may extend into the region overlapping the furnace chamber; flow from the burner chamber or burner axial flow chamber impinging upon the combustion substrate flange will be blocked, forming a low-flow region in the furnace chamber near the furnace wall 336.

Figure 8A:
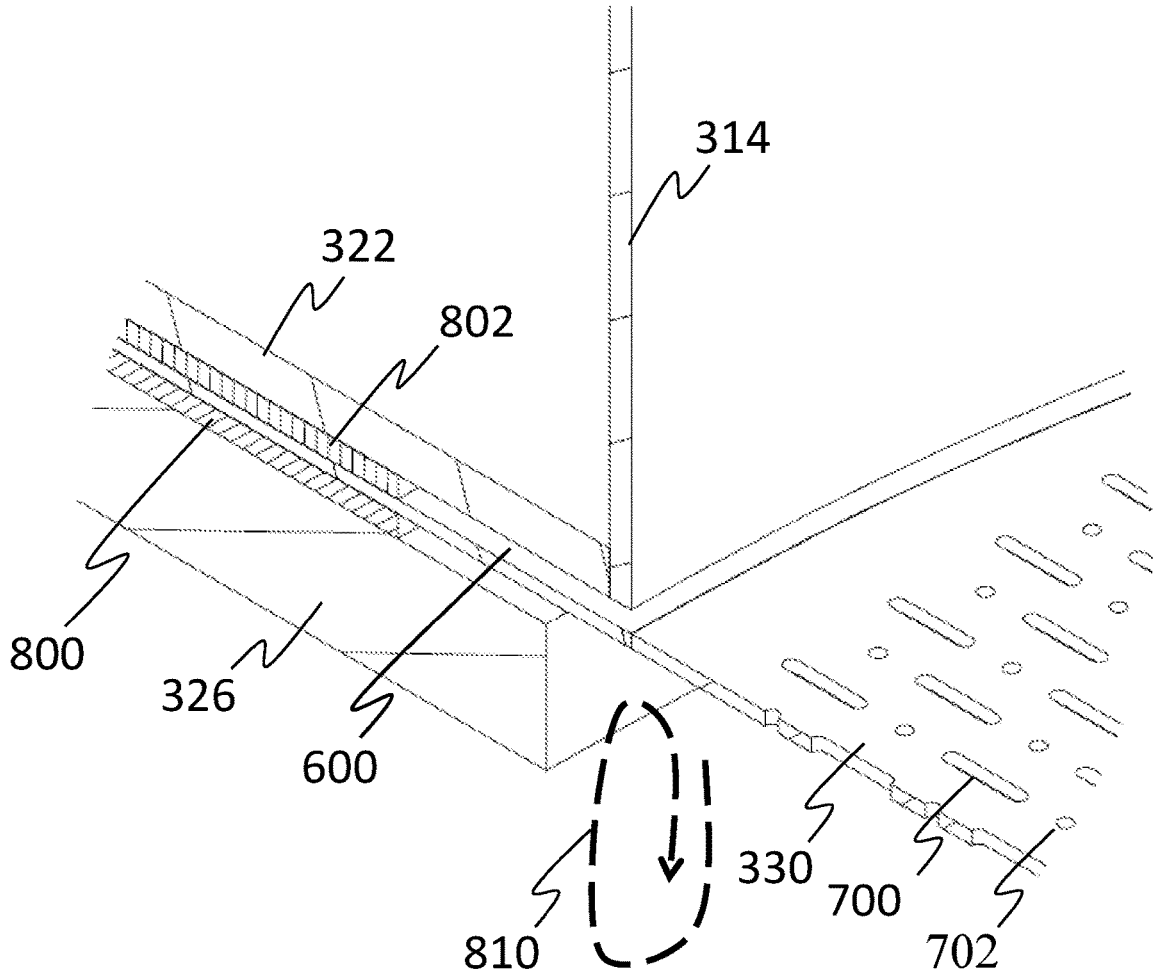
FIG. 8A shows an illustration of a region of the flat plate combustion substrate with a combination of circular pores and elongated pores together with a means for disposing the combustion substrate between the burner flange and furnace flange in accordance with embodiments of the present disclosure.

These aspects are further illustrated in FIG. 8A. The combustion substrate flange 600 is sandwiched between the burner flange 322 and the furnace flange 326 between an upper gasket 802 and a lower gasket 800. The perforated region of the combustion substrate 330 is populated by circular 702 pores and elongated slot 700 pores. Furthermore, a region of the combustion substrate flange inhibits flow near the burner wall 314 to create a recirculation zone 810 in the furnace cavity of the inner surface of the combustion substrate.

Figure 8B:
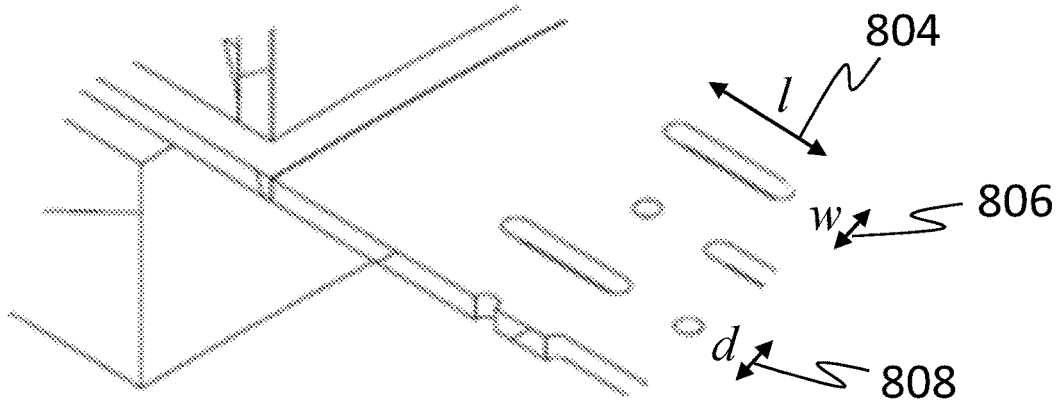
FIG. 8B shows an illustration of a region of the flat plate combustion substrate with a combination of circular pores and elongated pores and their conventional dimensions together with a means for disposing the combustion substrate between the burner flange and furnace flange in accordance with embodiments of the present disclosure.

In the discussion that follows, it will be convenient to discuss aspects of the pore shapes using nomenclatures illustrated in FIG. 8B. For convenience, we illustrate the principles using circular pores 700 and elongated slot 702 pores, but the principles are not limited to pores with these shapes and the Applicants intend that the claims extend to pores of arbitrary shapes including but not limited to pores of circular, elliptical, elongated, slot, square, rectangular, symmetrical shape, and asymmetrical shapes.

For circular pores 702, the planer diameter 808 of the pore on the outer surface of the combustion substrate may be denoted d. Elongated slot pores 700 may be characterized by two measurements, the length 805, denoted by l, and the width 806 denoted by w. Other pores shapes may have more complicated geometrical descriptions, but those skilled in the art of burner design know how to apply the thermodynamic and flow principles described below to pores of arbitrary shapes.

Figure 9:
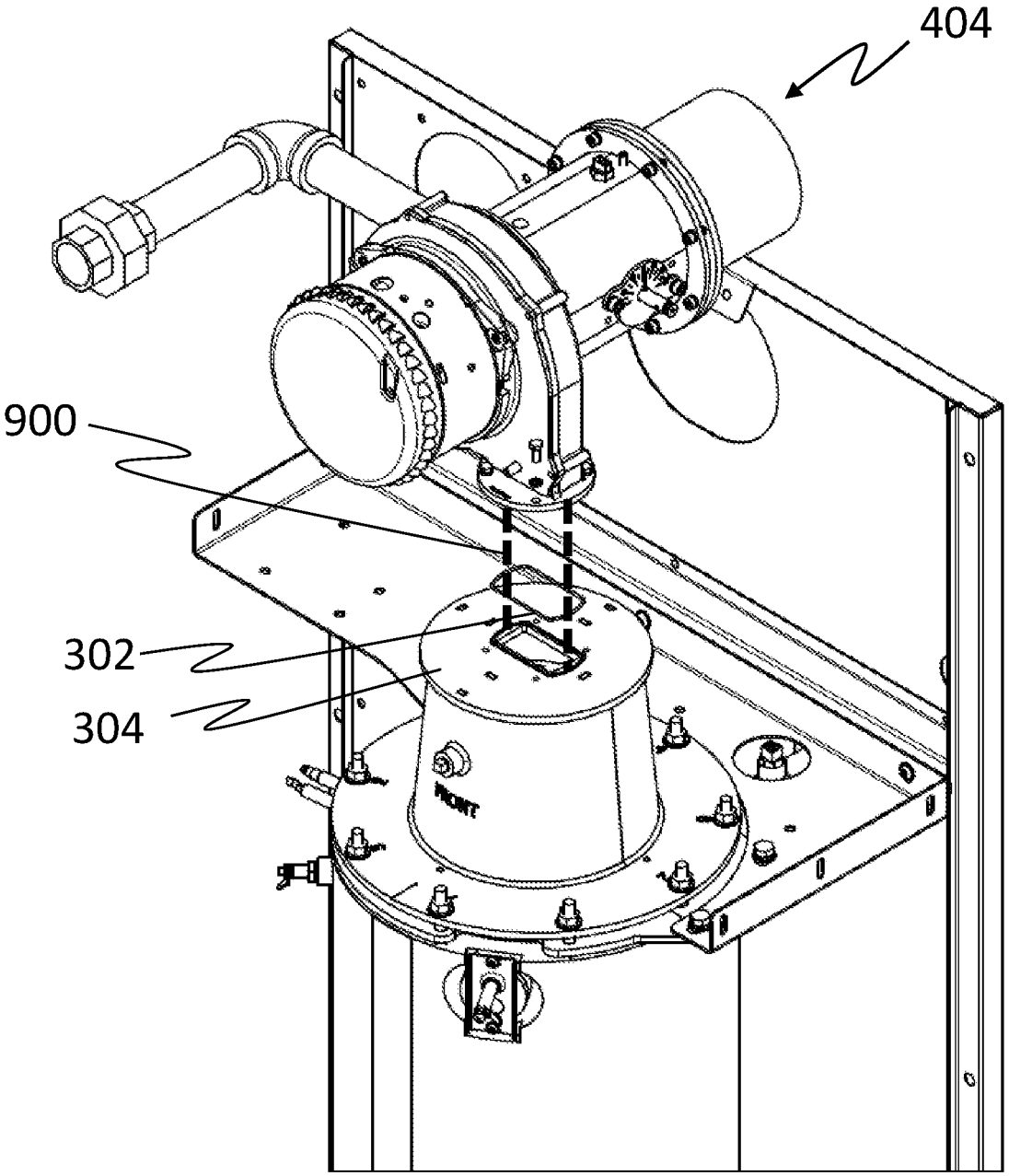
FIG. 9 shows a perspective drawing of an embodiment of a burner exterior, including the burner cap and burner wall, illustrating how the blower is disposed on the burner cap in accordance with embodiments of the present disclosure.

FIG. 9 illustrates an embodiment where the blower 404 is disposed on the burner cap 304 using a flexible sealing gasket 900.

Figure 10A:
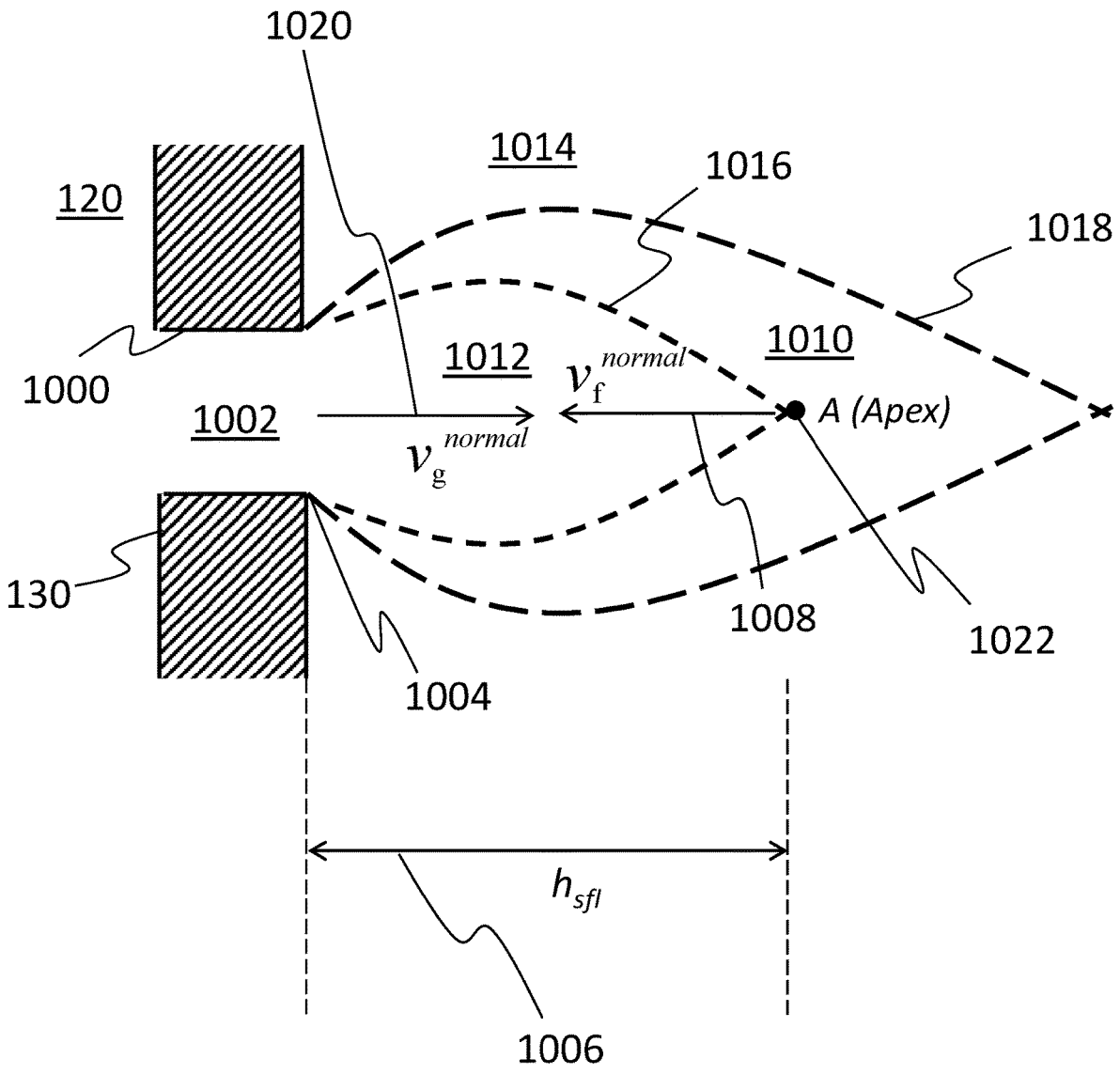
FIG. 10A shows an illustration of the velocity vectors comprising the calculation of the combustion flame equilibrium ratio (p) in the region between a porous combustion substrate and a flamelet in accordance with embodiments of the present disclosure.

Without being bound by theory, the burner combustion substrate provides a physical structure to support the flame front generated when the premix fuel-air mixture is ignited, and the porosity of the substrate determines certain aspects of the resulting combustion process as illustrated in FIG. 10A. A small region of the porous combustion substrate is shown together with a schematic of a pore 1000. In this drawing the fact that the pore provides a passage from an outside of the substrate to an inside of the substrate is illustrated, but not the two and three dimensional characteristics of the pore. The premix fuel-air mixture passes through the pore 1000 and enters the interior of the burner combustion substrate with a velocity $v_g$. The incoming fuel flow has a component 1020 normal to the burner combustion substrate, $v_g^{normal}$. The fuel-air mixture ignites to form a flame 1016 with a flame front 1018 which is operated on by a force which tends to move the flame front towards the pore with a velocity $v_f$ that also has a component 1008 normal to the combustion substrate, $v_f^{normal}$. An important burner combustion substrate principle is to design the porosity so that the flame front equilibrium ratio number, $$\rho = \frac{|v_f^{normal}|}{|v_g^{normal}|} \approx 1$$

That is, an important design characteristic is to select a burner substrate construction and porosity that ensures the flame front remains approximately stationary relative to the pore opening across the entire substrate area during operation, given the distribution and range of velocities of premix fuel flow through the substrate.

This means that, A, the apex 1022 of the flame separating the combustion zone 1010 from the incoming premix flow remains stationary in a time-averaged sense. That is, the apex 1022 may fluctuate, but it does so for the typical flamelet and for most of the time around some time-average stationary position above the inner surface of the combustion substrate—that is, within the furnace chamber 1014 at a positive distance 1006 denoted $h_{sf}$. Thus, the region of premix fuel 1012 flow within the flame structure—but under the autoignition temperature—lies inside the furnace chamber, separated 1016 from the flamelet combustion zone 1010, but all within the furnace chamber. Under normal operating conditions, this flamelet structure remains attached 1004 to the combustion substrate.

FIG. 10B further illustrates the time-averaged stationary behavior of the flamelet position. The diagram displays the instantaneous value of the apex 1022, A, of the flamelet combustion transition zone 1012 as a function of time. The apex, A, 1022 fluctuates stochastically around a time-average mean value 1055, driven by microscopic variations in premix fuel flow, interactions with surrounding flamelets, and other forces. Most of the time the flame structure conforms to the situation depicted in FIG. 10A as shown in FIG. 10C—the entire flamelet structure is attached to the inner combustion substrate surface, the apex, A, 1022 lies within the furnace chamber at a positive (non-constant) distance 1006 ($h_{sf1}>0$) from the combustion substrate inner surface. Infrequently, the apex makes a stochastically rare incursion into the pore, as depicted in FIG. 10D, where $h_{sf1}\leq 0$, a condition that—if uncontrolled—could lead to flashback.

The Applicants have surprisingly discovered that control of flashback can be achieved by judiciously using the heat capacity of the pore's metal surfaces to create a temperature gradient capable of ensuring that the flamelet combustion transition zone always remains below the fuel-air premix autoignition temperature, even during transient incursions of the flamelet into the pore. That is, the temperature, T, of the combustion transition zone 1012 satisfies the condition $T<T_{auto}$ even within the pore.

Figure 11:
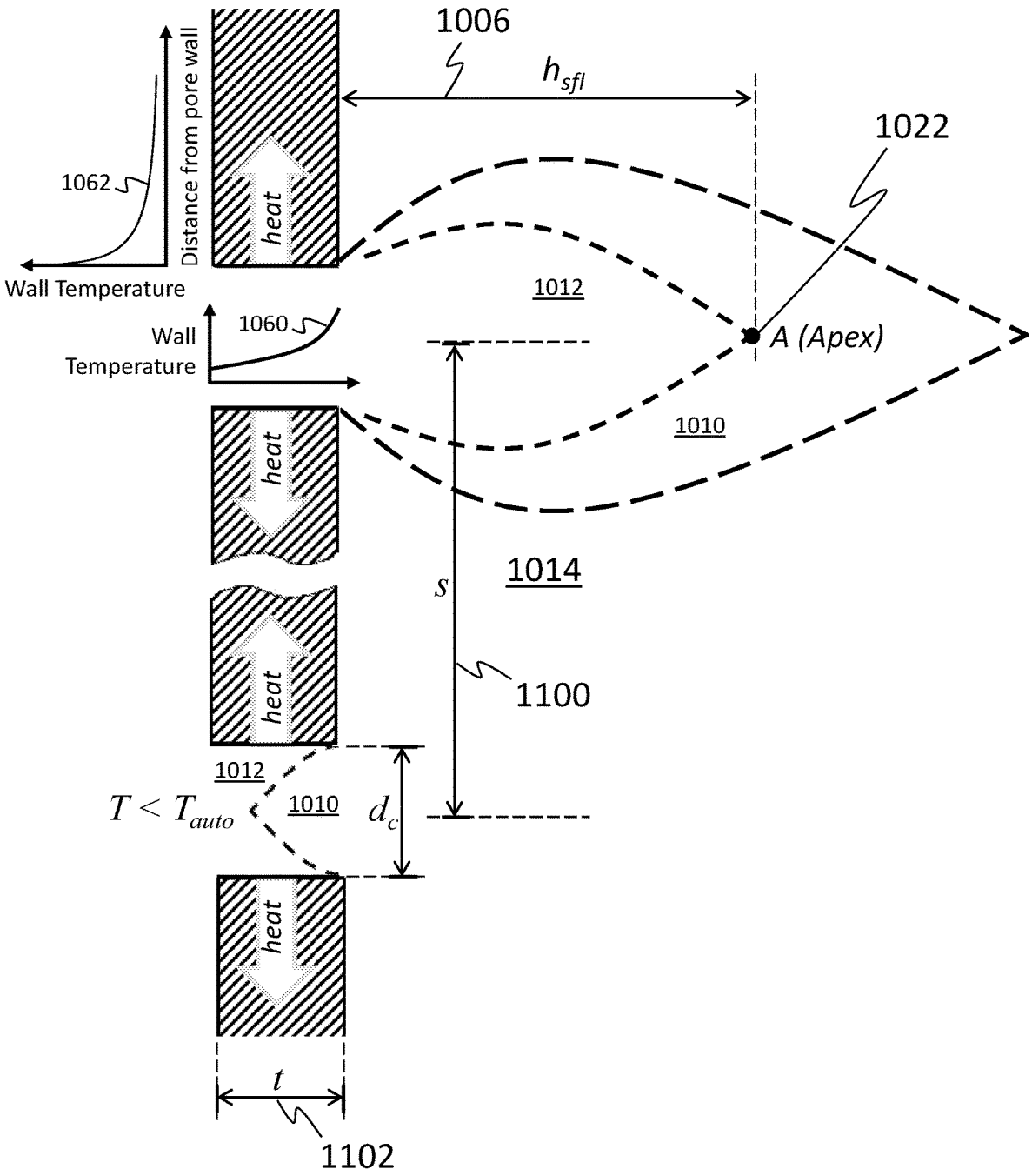
FIG. 11 illustrates the conduction of heat from the interior of a combustion substrate pore that can be exploited to control and inhibit burner flashback in accordance with embodiments of the present disclosure.

FIG. 11 illustrates these principles. The upper pore depicts the typical condition where the entire flamelet structure is attached to the inner combustion substrate surface, the apex, A, 1022 lies within the furnace chamber at a positive (non-constant) distance 1006 ($h_{sf1}>0$) from the combustion substrate inner surface. In approximate (time-average) equilibrium, temperature gradients exist along the depth of the pore 1060 and along the combustion substrate surrounding the pore 1062. Applying the heat equation, heat energy will flow down the temperature gradient away from the pore, cooling the premix and any flamelet structure that encroaches upon the pore volume for short periods.

Figure 12A:
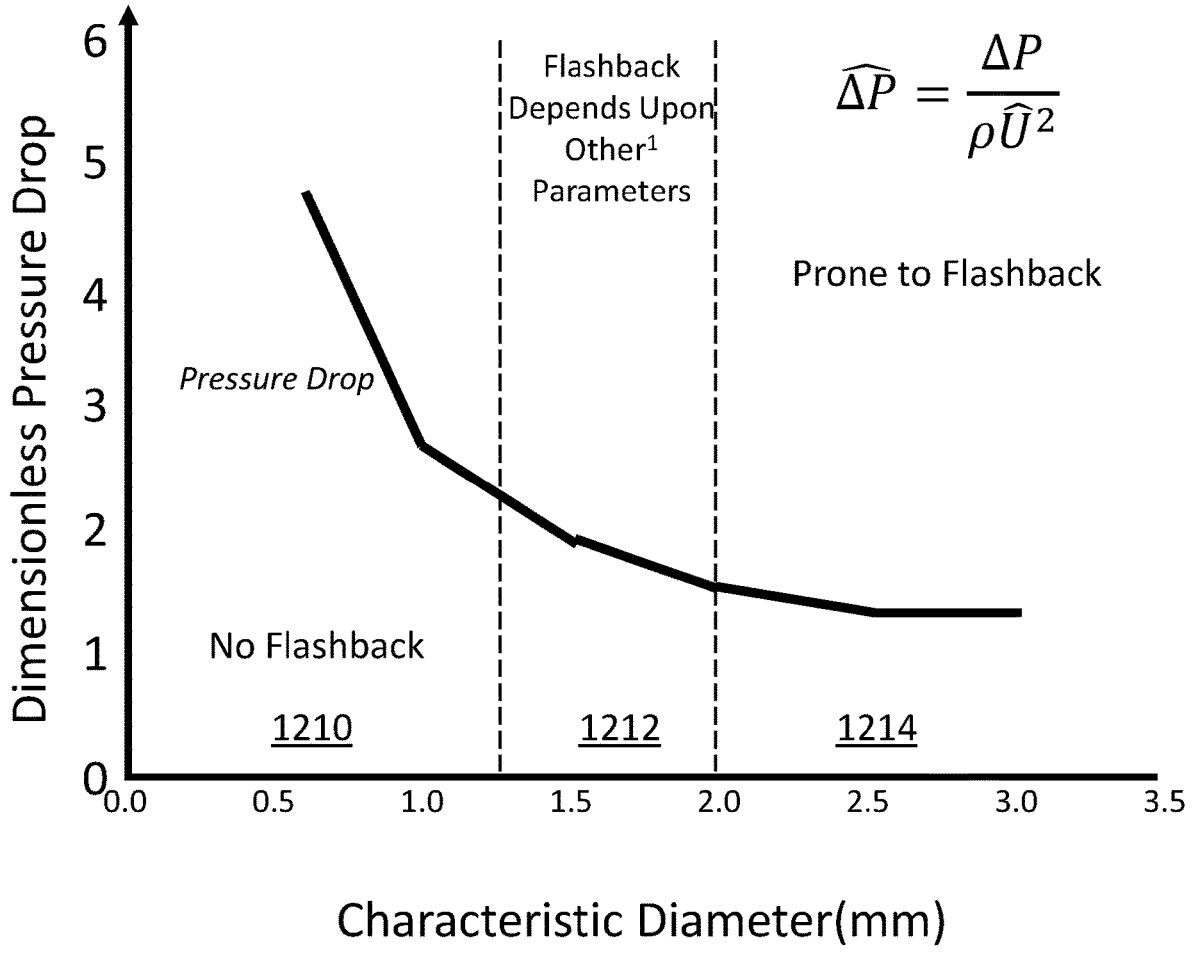
FIG. 12A shows the relationship between pore characteristic diameter and dimensionless pressure drop across the substrate, delineating a region where pore geometry and substrate material properties can be used to control burner flashback in accordance with embodiments of the present disclosure.
Figure 12B:
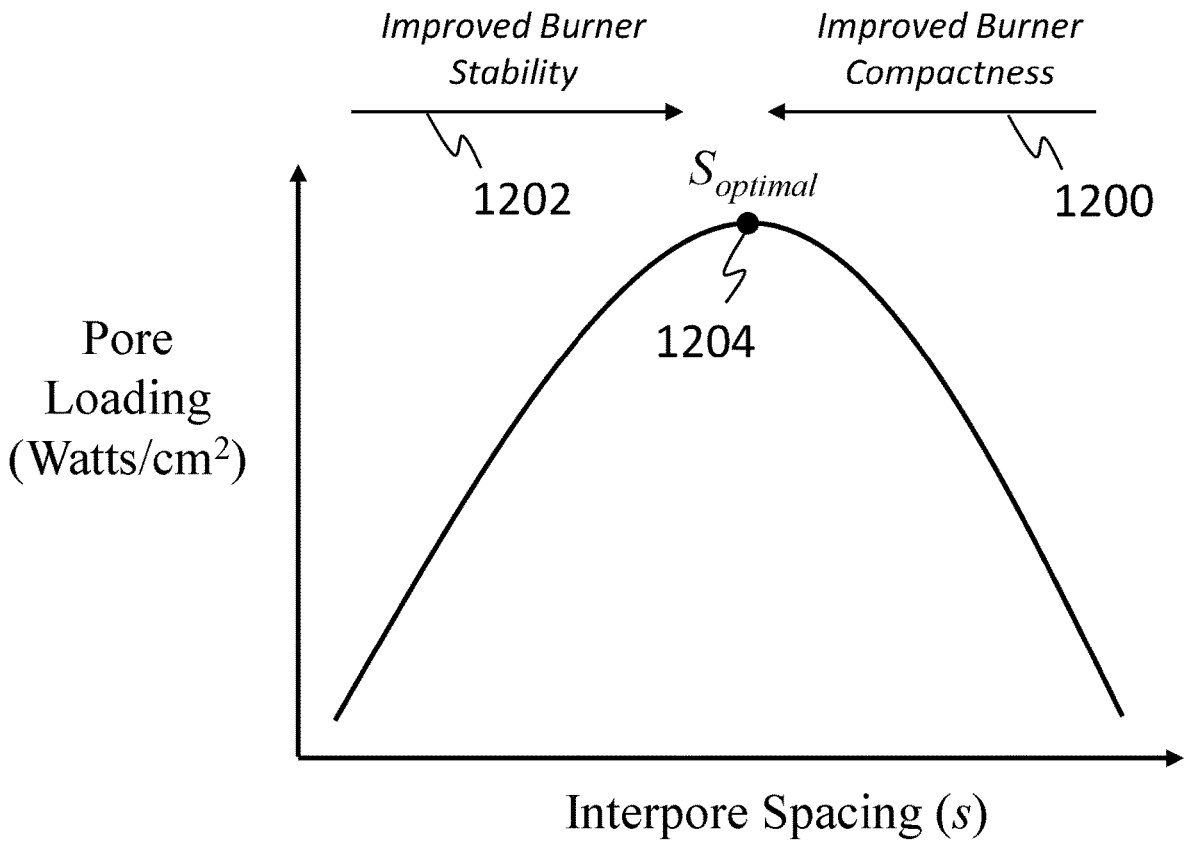
FIG. 12B illustrates the competitive relationship between interpore spacing and pore loading that results in an optimal pore distribution geometry on the surface of the combustion substrate in accordance with embodiments of the present disclosure.

It is useful to define a characteristic distance for a pore called the characteristic diameter, $d_c$. The characteristic diameter is the diameter of the circular pore that has the same effective distance of any point of the pore interior from the nearest point of the pore wall surface. For example, for a circular pore, $d_c$=d, the actual diameter of the pore as in 808 of FIG. 8B. For an elongated slot pore, $d_c$=w, since every point of the interior of the pore is exposed to a pore surface within w/2, just as for a circular pore of diameter, w. It is possible to define practical design relationships between of the thickness 1102, t, of the combustion substrate; the characteristic diameter of the pores, the combustion substrate material properties (e.g., heat capacity, convection rate, etc), and burner operating condition (e.g., flame temperature). FIG. 12A displays a typical relationship for a boiler application between characteristic diameter and pressure drop across the thickness of the combustion substrate. For pores with small characteristic diameters 1210, flashback is inhibited for high pressure drop operating conditions since the premix fuel-air mixture is being forced through the pore at such a high velocity ($v_g^{normal}$ FIG. 10A) that, $$\rho = \frac{|v_f^{normal}|}{|v_g^{normal}|} >> 1 \qquad \text{(EQUATION 1)}$$

and the fluctuations virtually never cause the apex, A, to intrude into the pore. For pores with large characteristic diameters 1214, $v_f$ is often insufficient to overcome $v_g$, and the flame front penetrates the pore frequently and, often, for long lengths of time making the operating condition prone to flashback. However, in the region of moderate pore characteristic diameters 1212, the thermodynamic heat conduction properties of the pore walls can be exploited to maintain the premix below the autoignition temperature of the premix, thus inhibiting flashback.

An important design parameter in the inhibition of flashback using combustion substrate pore geometry is the thickness, t, of the combustion substrate. Numerical and empirical experiments indicate that, generally, for embodiments comprising steel combustion substrates, effective control of flashback can be achieved for practical operating conditions where the ratio of the combustion substrate thickness to the pore characteristic diameter, $t/d_c$, is greater than approximately 0.5. A practical manufacturing upper limit today provides that the ratio of the combustion substrate thickness to the pore characteristic diameter is less than approximately five, which tends to be the cost-effective plate thickness limit for perforating a steel plate. Thus, $$0.5 \leq \frac{t}{d_c} \leq 5 \qquad \text{(EQUATION 2)}$$

provides practical design guidelines for flashback control using pore geometry and substrate dimensions. In typical boiler applications, it has been found that for steel combustion substrates, circular pores with diameters between approximately 0.5 millimeters and 4 millimeters are useful for flashback control while still achieving manufacturable, compact designs. For elongated slot pores, empirical results show that pores having widths between about 0.5 millimeters and about 4 millimeters and lengths between about 2 millimeters and about 15 millimeters are manufacturable and useable for flashback control.

FIG. 12 B shows the relationship between interpore spacing and pore loading. Interpore spacing is important because reducing the space between pores on the combustion substrate surface increase the substrate heat load (watts/centimeter$^2$) and the burner power density, decreasing the volume of the burner required to achieve a specific burner heat capacity objective, thereby enabling compact burner subsystems. However, as the interpore spacing begins to crowd the pores too closely on the substrate surface the flamelets begin dynamically coupling which can cause detachment of the flamelets from the pores, lifting of the flame front, blowout harmonic oscillations and other symptoms of combustion instability. For a particular set of design parameters, there is typically an optimal interpore spacing that achieves the best balance of burner subsystem compactness, operating efficiency and stability.

The strategy to inhibit flashback and combustion instability can be exploited by one skilled in the art of burner design by describing the engineering approach in greater detail, as follows. Without being bound by theory, the concept of inhibiting flashback using judicious choices of combustion substrate geometrical parameters can be expressed as a type of mechanical open-loop control problem as follows: For a premix fuel with autoignition temperature, $T_{auto}$, and a substrate material with prescribed physical and mechanical properties (e.g., density, thermal conductivity, k, where $q=-k\nabla T$ defines the relationship between heat flux, q, and the local temperature gradient, $\nabla T$, across the pore surface), choose the pore characteristic diameter, $d_c$, together with the substrate thickness, t, so that the average quenching time, $$\bar{\tau}_w \geq T \qquad \text{(EQUATION 3)}$$

is equal to or exceeds a designer's choice for a threshold minimum, $T_q$. Here the average quenching time is the average duration of stochastic events where the apex, A, of flamelets penetrate into the pores whose premix flow supports their combustion as illustrated in FIG. 10D. Notice that this defines a time-averaged and space-averaged control objective over the furnace-side combustion substrate surface: The substrate thickness and pore characteristic diameter combination must be determined so that the occurrence of flashback events (events where a flamelet penetrates into the pore so far—and for so long—that the temperature at the apex, A, is not quenched below the autoignition temperature preventing ignition of the fuel entering the pore) is very rare or never occurs, while still achieving all the other design burner design parameters (e.g., burner weight, heat capacity, manufacturability, material longevity, etc).

Figure 12C:
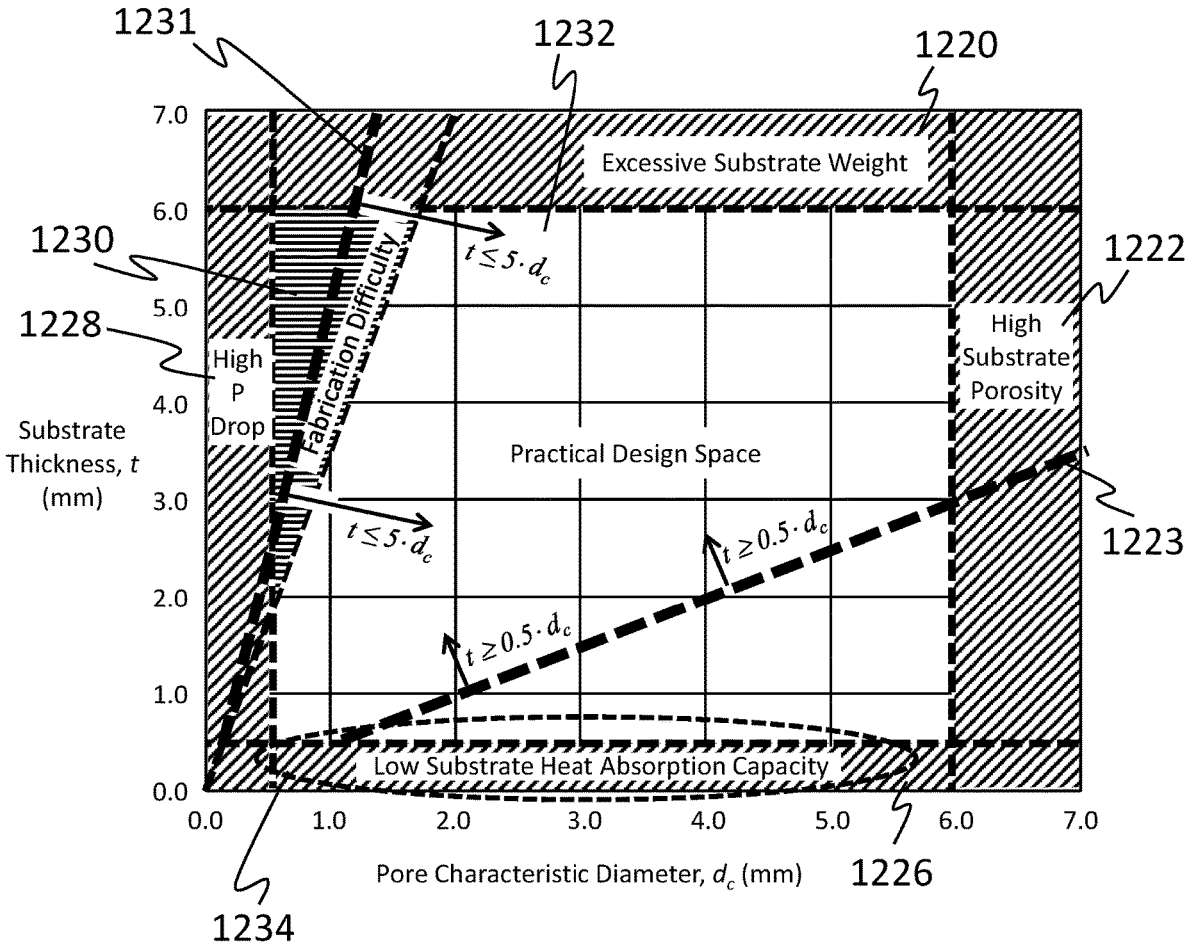
FIG. 12C illustrates several key features of the practical design space for controlling flashback using the substrate properties in accordance with embodiments of the present disclosure.

FIG. 12C further illustrates the open-loop mechanic control design problem described above that illustrates an aspect of the present disclosure. The upper bound 1231 and lower bound 1223 defined by the empirical guideline cited above as EQUATION 2 (mathematically equivalent to the dual conditions $t \geq 0.5 \cdot d_c$ and $t \leq 5 \cdot d_c$) defines the practical design space for the selection of the substrate thickness, t, and the characteristic pore diameter, $d_c$. Within this practical design space, properties of the materials used, boiler components, cost and manufacturing methods considered by the designer add features important to specific design situations. For example, it has been discovered that for substrate with physical and material properties similar to steel used as the combustion substrate, a region 1226 (low substrate heat absorption capacity) characterized by thicknesses below approximately 0.5 millimeters lacks a sufficient volume of material adjacent to the pore to effectively conduct heat away from the walls of the pore and, thus, cannot quench flashback events of durations seen in practice. Thus, one skilled in the art of burner design may impose a practical boundary for usable substrate thickness, t, that is greater than or equal to a predetermined low substrate thickness value indicative of a low substrate heat absorption capacity. One-half (0.5) millimeter is specifically mentioned, but the specific details and operating objectives of particular burner design problem may impose a different practical limit. While very small pore diameters are effective at flashback quenching, pores with characteristic diameters smaller than 0.5 millimeter for a region 1228 (high pressure (P) drop), causes high pressure drop across the burner substrate assembly, requiring high blower pressure and speeds to overcome the flow resistance. Thus, one skilled in the art of burner design may impose a practical boundary for usable pore characteristic diameters, $d_c$, is greater than or equal to a predetermined low characteristic diameter value indicative of a high pressure drop. One-half (0.5) millimeter is specifically mentioned, but the specific details and operating objectives of particular burner design problem may impose a different practical limit. Very thick combustions substrates permit effective conduction of heat away from the pore, but combustion substrates six (6) millimeters and greater form a region 1220 (excessive substrate weight) where a steel substrate is physically unwieldy, heavy and impractical for commercial and industrial applications. Thus, one skilled in the art of burner design may impose a practical boundary for usable substrate thickness, t, is less than or equal a predetermined substrate thickness value indicative of an excessive substrate weight. Six (6) millimeters is specifically mentioned, but the specific details and operating objectives of particular burner design problem may imposed a different practical limit. The region 1230 characterized by thick combustion substrate and small pore characteristic diameter involves significant manufacturing obstacles, since current technologies for forming small pores in thick steel structures are difficult to control and require expensive apparatus. Thus, one skilled in the art of burner design may impose a practical boundary for usable substrate thickness, t, and at least one pore characteristic diameter, $d_c$, set so as to reduce fabrication difficulty. The boundary defined by the inequality $t \leq 6 \cdot d_d$ (substrate thickness, t, is less than or equal to six times the characteristic diameter, $d_c$) is specifically mentioned, but the specific details and operating objectives of particular burner design problem may imposed a different practical limit. Finally, in the region 1222 (high substrate porosity) of high pore characteristic diameters of six (6.0) millimeters or larger, the large flow velocity and fluid velocity premix flow through the pore tends to cause the flamelet to become detached from the furnace-side surface of the substrate, causing flame combustion instability issues. Thus, one skilled in the art of burner design may impose a practical boundary for usable pore characteristic diameters, $d_c$, to be that at least one pore characteristic diameter, $d_c$, which is indicative of substrate porosity, is less than or equal to a predetermined high characteristic diameter value or a predetermined high substrate porosity value, indicative of a high substrate porosity. Six (6) millimeters for the pore characteristic diameter is specifically mentioned, but the specific details and operating objectives of particular burner design problem may impose a different practical limit. The practical obstacles formed by the low substrate heat absorption capacity region 1226 below t=0.5 mm, the high pressure drop region 1228 below $d_c$=0.5 mm, the region 1220 of excessive substrate weight above t=6.0 mm, the high substrate porosity region 1222 above $d_c$=6.0 mm, and the region 1230 where substrate manufacture is impractical and/or expensive forms an effective or practical design region 1232 (equivalently, effective or practical design space) for viable combinations of pore characteristic diameter and substrate thickness can be selected depending on the stochastic dynamics of flamelet combustion. Within the resulting bounded region 1232 of practical substrate thickness and characteristic diameter selections, it has been discovered that some combinations of t and $d_c$ will exhibit both flamelet combustion stability and effective flashback inhibition, while in other regions either or both the flamelet combustion stability and/or flashback inhibition will be degraded and, therefore, form unusable combinations.

The practical design region 1232 bounded by excessive weight (approximately t≥6.0 millimeters), inadequate thermal heat conductivity (approximately t≤0.5 millimeters), high porosity (approximately $d_c$≥6.0 millimeters), and high pressure drop (approximately $d_c$≤0.5 millimeters) constraints are affected by specific system design and parameter choices including burner component choices (e.g., blower), substrate material properties (e.g., metal composition, heat conductivity, density and weight), substrate porosity, and pore geometries (e.g., hole and/or slot shapes). For example, one skilled in the art of burner design may use a high-speed blower or fan to overcome the high pressure drop imposed by very small pores with characteristic diameters less than 0.5 mm, thus moving the practical boundary of the practical design region 1228 to the left to include small pores; or utilize substrate designs with higher substrate porosity (fraction of the substrate surface area occupied by the pore openings, equal to one-hundred percent (100%) minus the substrate solidity), thereby lowering the weight substrates to include the use of substrates with thicknesses greater than 6 mm and increasing the boundary of the region 1232 of usable thicknesses above 6 mm; or utilize pore geometries that increase the substrate porosity for characteristic diameters greater than 6 mm but maintain flamelet stability, thereby moving the boundary of the region 1222 of usable diameters to include pore characteristic diameters, $d_c$, greater than 6 mm. These are not the only parameters that may constrain the design space. Other values may be used if desired provided they provide the desired function and performance described herein.

As described above, all known solid combustion substrates utilize thin (approximately 0.5 millimeter) sheet metal materials over a range of pore characteristic diameters with various pore shapes, occupying a region 1234 of FIG. 12C where the substrate has little or no heat absorption capacity.

Figure 12D:
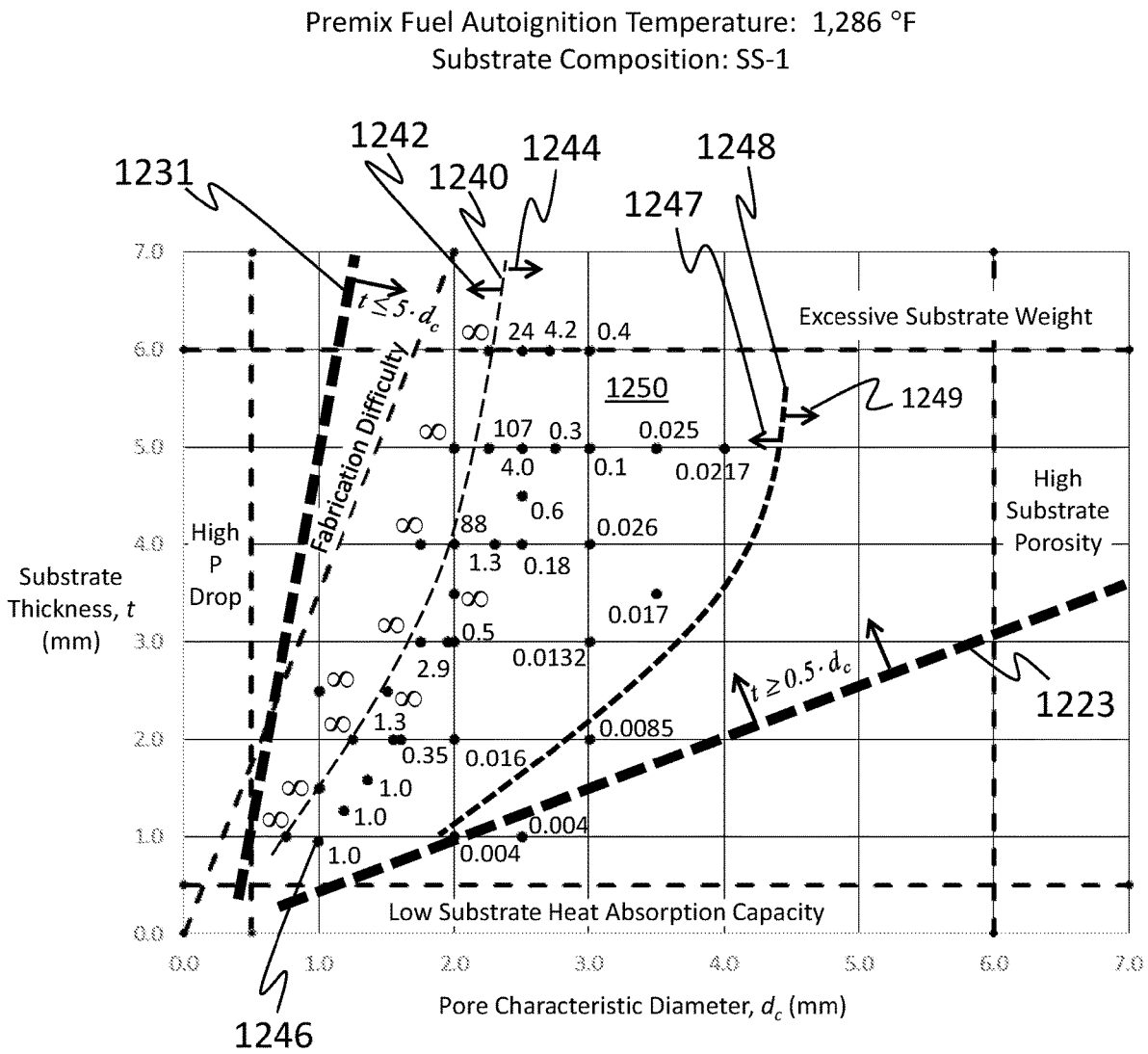
FIG. 12D displays a plot of values obtained by numerical simulation showing transient flashback quelching duration as a function of pore characteristic diameter and combustion substrate thickness for SS-1 (ASTM XM-8/S43035) stainless steel in accordance with embodiments of the present disclosure.

FIG. 12D displays illustrative results using the methods of Computational Fluid Dynamics (CFD) simulations. The results are provided as indicative of the principles involved; however, the parameters and values may vary for any specific burner design problem and may be embodied in many different forms, and the examples should not be construed as limited to the embodiments set forth herein. Rather, these embodiments and results are provided so that this disclosure will be thorough and complete, and will fully convey the scope of the disclosure to those skilled in the art. The applicants intend that the claims extend to all equivalent embodiments, design parameters, and component values and operating conditions consistent with the present disclosure. Other embodiments will fall within the scope of the invention as defined by the claims. FIG. 12D shows values of average quenching time, $\overline{\tau}_q$, (shown as black dots, e.g., dot 1246) in seconds as a function of substrate thickness, t, and pore characteristic diameter, $d_c$. For the purposes of the numerical simulation, practical values of operating materials and conditions typical if commercial and industrial applications use used: The substrate material, SS-1, simulated is a titanium-stabilized ferric stainless steel, 18 percent chromium alloy, also known by the ASTM International (formerly, American Society for Testing and Materials) designation ASTM XM-8 and by the UNS unified numbering system (UNS) alloy system designation S43035 with density 7.695 grams/centimeter$^3$ and thermal conductivity 25 Watts/meter·Kelvin. The simulated autoignition temperature of the premix fuel-air mixture used was 697 degrees Celsius (697° C.) (1,286 degrees Fahrenheit, equivalently 1,286° F.). The flame temperature used in the simulation was 1,760° C. (3,200° F.). The temperature on the boundary layer of the furnace-side surface of the combustion substrate was approximately 927° C. (1,700° F.), the temperature on the pore inlet side surface of the combustion substrate in room temperature approximately 26.7° C. (approximately 80° F.), and the equilibrium substrate metal temperature is maintained less than 371° C. (700° F.). These were also approximately the values in prototype empirical experiments of actual substrates in a test harness built for the purpose of verifying the calculated results.

FIG. 12D shows the maximum time duration in seconds of flashback events that will be rejected as a function of pore characteristic diameter, $d_c$, and substrate thickness, t, using the simulation parameters described above. For example, for a substrate that has a thickness of one (1) millimeter and a pore of one (1) millimeter characteristic diameter, flashback events of one (1) second or shorter 1246 will be extinguished by the action of the substrate surrounding the pore carrying heat away from the pore interior and, thus, maintaining the temperature of the premix fuel-air mixture near the pore inlet (equivalently, at the flashback flamelet apex, A) below the autoignition temperature. The simulated data shows that the substrates with the material properties similar to metals like various steel compositions have a high capacity for quenching transient flashback events into the pore, increasing with substrate thickness; in fact, there is a region to the left 1242 of a boundary 1240 (called the quenching boundary, bounding a region where particular design choices of substrate material, premix flow rate, autoignition temperature where a flashback event (penetration of flamelet into the pore) of arbitrarily long duration will be extinguished) result in quenching effectiveness of the heat conduction away from the interior surface of the pore sufficient to extinguish virtually any protrusion of the flamelet into the pore for an arbitrarily long time duration. For choices of substrate thickness, t, and pore characteristic diameter, $d_c$, to the left 1242 of the quenching boundary 1240, flashbacks that ignite the incoming premix fuel-air mixture on the inlet side of the combustion substrate appear to be effectively inhibited. That is, in an open-loop control sense, the rejection of flashback perturbations is essentially infinite (equivalently, essentially absolute) to the left of the quenching boundary.

To the right 1244 of the quenching boundary 1240, individual flashback events remain possible, but sufficiently near the quenching boundary 1240, a flashback event (flamelet penetration into the pore) must persist for a long time to risk igniting the premix fuel-air mixture on the inlet side of the combustion substrate—typically a rare event. In other words, the open-loop mechanical control of flashback events created by a combination of substrate thickness, t, and pore characteristic diameter, $d_c$, close to the quenching boundary 1240 strongly rejects stochastic perturbations of the flamelet position and pore temperature distribution due to combustion dynamics into the pore interior, including long-duration protrusions of the flamelet into the pore shorter than a threshold time duration.

The threshold duration for flashback event rejection for points to the right (larger pore characteristic pore diameter; thinner substrate thickness) becomes shorter as the pore characteristic diameter, $d_c$, increases and the substrate thickness, t, decreases. Both numerical experiments and empirical testing shows that the threshold duration for flashback event rejection should be maintained greater than approximately one (1.0) millisecond (ms) to yield practical burner operational performance. Thus, a useful operational boundary called the rejection boundary 1248 can be used to isolate a region 1250 between the quenching boundary and the rejection boundary where combinations of the characteristic diameter, $d_c$, and the substrate thickness, t, yield burner designs that reject flashback and flamelet instability (flamelet detachment, combustion extinguishment, vibration and other common instability effects) while maintaining manageable substrate weight and cost-effective manufacturing requirements. Good engineering practice suggests maintaining a design margin in establishing the rejection boundary 1248; empirical results suggest setting the rejection boundary 1248 to maintain the threshold duration at approximately ten (10) milliseconds (ten times the empirically derived stability boundary) or larger to be adequate in practice. In summary, the design region 1250 bounded by the quenching boundary 1240 and the rejection boundary 1248 provides a range of substrate thicknesses, t, and pore characteristic diameters, $d_c$, that exhibit burner performance relatively free of flashback events and combustion instability. To the right 1249 of the rejection boundary, instability and flashback occurs; to the left 1247 of the rejection boundary combustion is mechanically stabilized and flashback protrusion of the flamelet into the pores are quenched below the autoignition temperature of the pre-mix fuel-air mixture. Thus, the closer the parameter selections are made to the right 1244 side of the quenching, the longer the duration of flashback protrusion that can be rejected, but at the cost of decreasing pore size and/or increasing substrate thickness. As stated above, numerical experiments and empirical testing shows that the inequalities defined by EQUATION 2 provides a practical design guideline for the choice of the substrate thicknesses, t, and pore characteristic diameters, $d_c$.

The design region 1250 is also bounded by excessive weight (approximately $t \geq 6.0$ millimeters), inadequate thermal heat conductivity (approximately $t \leq 0.5$ millimeters), high porosity (approximately $d_c \geq 6.0$ millimeters), and high pressure drop (approximately $d_c \leq 0.5$ millimeters) constraints. However, it is important to note that these are practical limits imposed by widely available cost-effective manufacturing methods, constraints that may be relaxed by improvements in manufacturing technologies. Other values may be used if desired provided they provide the desired function and performance described herein. In particular, these guidelines are not inherent limitations in the present disclosure of exploiting perforated solid combustion substrates to control premix fuel-air mixture flashback and combustion instabilities.

Figure 12E:
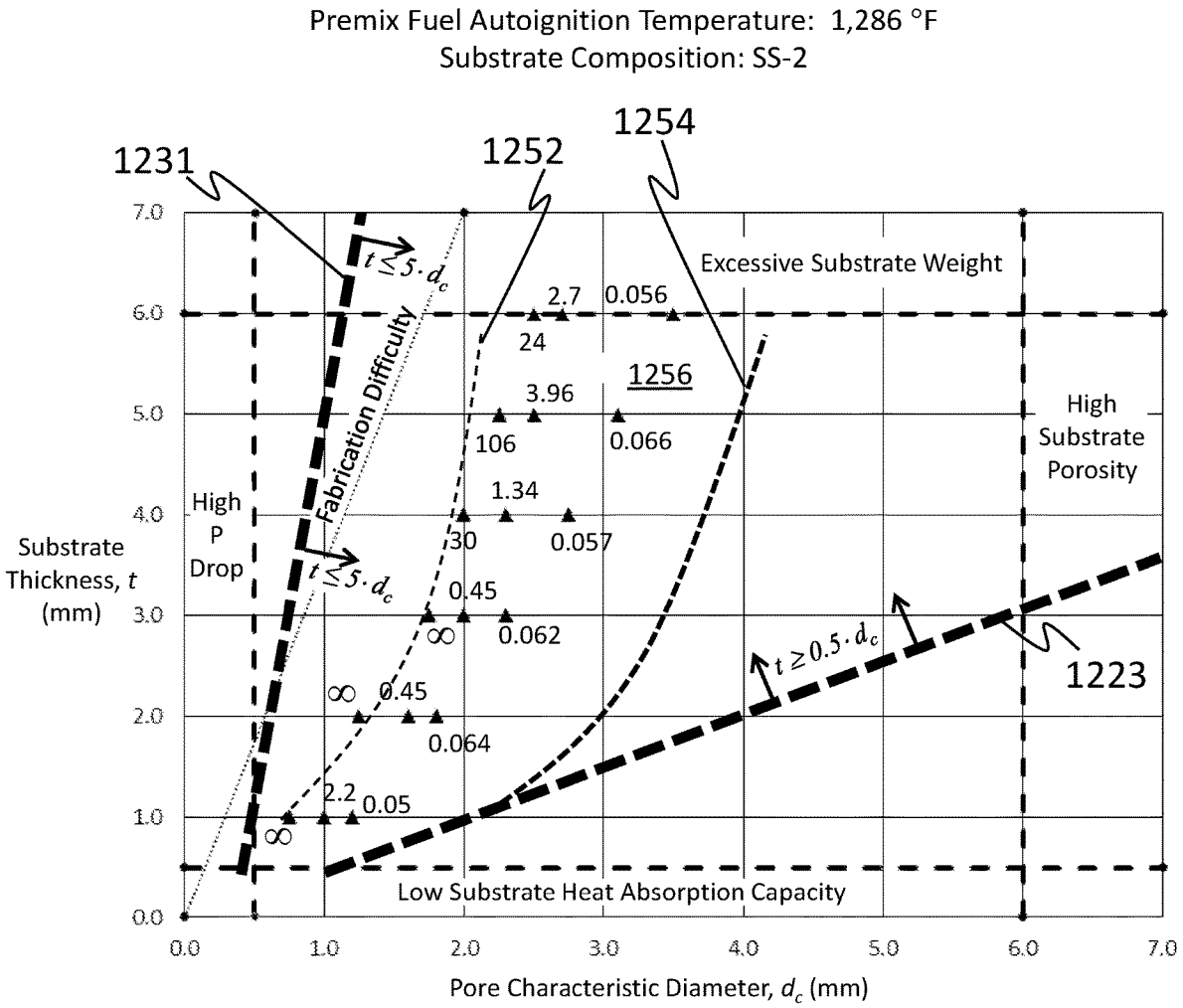
FIG. 12E displays a plot of values obtained by numerical simulation showing transient flashback quelching duration as a function of pore characteristic diameter and combustion substrate thickness for SS-2 stainless steel in accordance with embodiments of the present disclosure.

FIG. 12E displays illustrative results using the methods of Computational Fluid Dynamics (CFD) simulations. The results are provided as indicative of the principles involved; however, the parameters and values may vary for any specific burner design problem and may be embodied in many different forms, and the examples should not be construed as limited to the embodiments set forth herein. Rather, these embodiments and results are provided so that this disclosure will be thorough and complete, and will fully convey the scope of the disclosure to those skilled in the art. The applicants intend that the claims extend to all equivalent embodiments, design parameters, and component values and operating conditions consistent with the present disclosure. Other embodiments will fall within the scope of the invention as defined by the claims. FIG. 12E shows values of average quenching time, $\bar{\tau}_q$, (shown as black triangles) in seconds as a function of substrate thickness, t, and pore characteristic diameter, $d_c$. For the purposes of the numerical simulation shown in FIG. 12E, practical values of operating materials and conditions typical of commercial and industrial applications use used: The substrate material, SS-2, simulated is a titanium-stabilized ferric stainless steel, with a lower thermal conductivity (approximately 22 Watts/meter·Kelvin at an operating temperature of 700° F.) than used for the simulation results shown in FIG. 12D, but the composition possesses favorable corrosion properties in high temperature applications. The simulated autoignition temperature of the premix fuel-air mixture used was 697° C.) (1,286° F.). The flame temperature used in the simulation was 1,760° C. (3,200° F.). The temperature on the boundary layer of the furnace-side surface of the combustion substrate was approximately 927° C. (1,700° F.), the temperature on the pore inlet side surface of the combustion substrate in room temperature approximately 26.7° C. (approximately 80° F.), and the equilibrium substrate metal temperature is maintained less than 371° C. (700° F.)

FIG. 12E shows the maximum time duration in seconds of flashback events that will be rejected as a function of pore characteristic diameter, $d_c$, and substrate thickness, t, using the simulation parameters described above. As before, the simulation data indicates that a design region 1256 is defined between the quelching boundary 1252 and the rejection boundary 1254 that provides a range of substrate thicknesses, t, and pore characteristic diameters, $d_c$, that exhibit burner performance relatively free of flashback events and combustion instability. To the right of the rejection boundary 1254, instability and flashback occurs; to the left of the rejection boundary 1254, combustion is mechanically stabilized and flashback protrusion of the flamelet into the pores are quenched below the autoignition temperature of the pre-mix fuel-air mixture. Also shown is the simple guideline, $t \leq d_c/2$, of values useful for selection combinations of substrate thicknesses, t, and pore characteristic diameters, $d_c$, in contrast to the detailed quelching boundary 1252 and the rejection boundary 1254 that must be analyzed by complex CFD simulation or empirical testing for specific substrate materials, design parameters and operating conditions for precise determination.

As before, the design region 1256 is also bounded by excessive weight (approximately $t \geq 6.0$ millimeters), inadequate thermal heat conductivity (approximately $t \leq 0.5$ millimeters), high porosity (approximately $d_c \geq 6.0$ millimeters), and high pressure drop (approximately $d_c \leq 0.5$ millimeters) constraints. Other values may be used if desired provided they provide the desired function and performance described herein. However, as described before, these are practical limits imposed by widely available cost-effective manufacturing methods, constraints that may be relaxed by improvements in manufacturing technologies. In particular, these guidelines are not inherent limitations in the present disclosure of exploiting perforated solid combustion substrates to control premix fuel-air mixture flashback and combustion instabilities.

The CFD simulation data is confirmed by empirical test data displayed in FIG. 12F for test conditions shown in TABLE 1 below. Data for eight prototype tests are displayed for a variety of pore geometries, pore characteristic diameters, $d_c$, and substrate thicknesses, t. These empirical tests involve manufactured substrates that maintain a 90% solidity (where solidity is 100% minus the porosity); that is, 90% of the substrate surface is solid material, while 10% of the surface constitutes pore openings (or 10% porosity). Recall that the pore characteristic diameter, $d_c$, is a measure of the effective distance of any point of the pore interior from the nearest point of the pore wall surface available to conduct heat away from the premix fuel-air mixture. Thus, the characteristic diameter, $d_c$, allows for analysis of various pore patterns based on their similarity in heat conduction properties.

TABLE 1

Empirical Prototype Test Results

| Label | Substrate Thickness, t (mm) | Characteristic Diameter, $d_c$ (mm) | Pore Pattern | Flashback Result | Flamelet Stability Result |
|---|---|---|---|---|---|
| E1 | 0.8 | 0.7 | Slot | No Flashback | Unstable |
| E2 | 1.0 | 2.0 | Slot & Hole | Flashback | — |
| E3 | 0.8 | 3.0 | Keyhole | Flashback | — |
| E4 | 1.0 | 2.0 | Keyhole | Flashback | — |
| E5 | 1.0 | 1.0 | Long Slot | No Flashback | Unstable |
| E6 | 1.0 | 1.0 | Short Slot | No Flashback | Unstable |
| E7 | 1.0 | 1.0 | Slot & Hole | No Flashback | Stable |
| E8 | 2.5 | 1.0 | Slot & Hole | No Flashback | Stable |

The substrate material, SS-1, used for the empirical studies is a titanium-stabilized ferric stainless steel, 18 percent chromium alloy, also known as ASTNM XM-8 and by the UNS designation S43035 with density 7.695 grams/centimeter$^3$ and thermal conductivity 25 Watts/meter·Kelvin. The autoignition temperature of the premix fuel-air mixture used was 697° C. (1,286° F.). The flame temperature was 1,760° C. (3,200° F.). The temperature on the boundary layer of the furnace-side surface of the combustion substrate was approximately 927° C. (1,700° F.), the temperature on the pore inlet side surface of the combustion substrate in room temperature approximately 26.7° C. (approximately 80° F.), and the equilibrium substrate metal temperature is maintained less than 371° C. (700° F.) for the test operating conditions. The pressure drop across the combustion substrate was between 200 Pa and 500 Pa (0.8 and 2.0 inches of water column) depending upon the specific substrate thickness, t, pore characteristic geometry, $d_c$, and pore geometry. (Fan pressure in the test setup is essentially incomparable to the in vivo operational configuration since—except for the pressure drop across the substrate—there was no backpressure imposed by other system components such as the furnace, heat exchanger or flue.) A typical high-performance burner that may be designed for use in a commercial or industrial application using substrate configurations displayed in TABLE 1 may utilize a corresponding blower with fan tip speed of 11,000 RPM and produce a static pressure of between 6,200 Pa to 7,500 Pa. These were also approximately the values used to produce the simulation results shown in FIG. 12D and FIG. 12E.

Figure 12F:
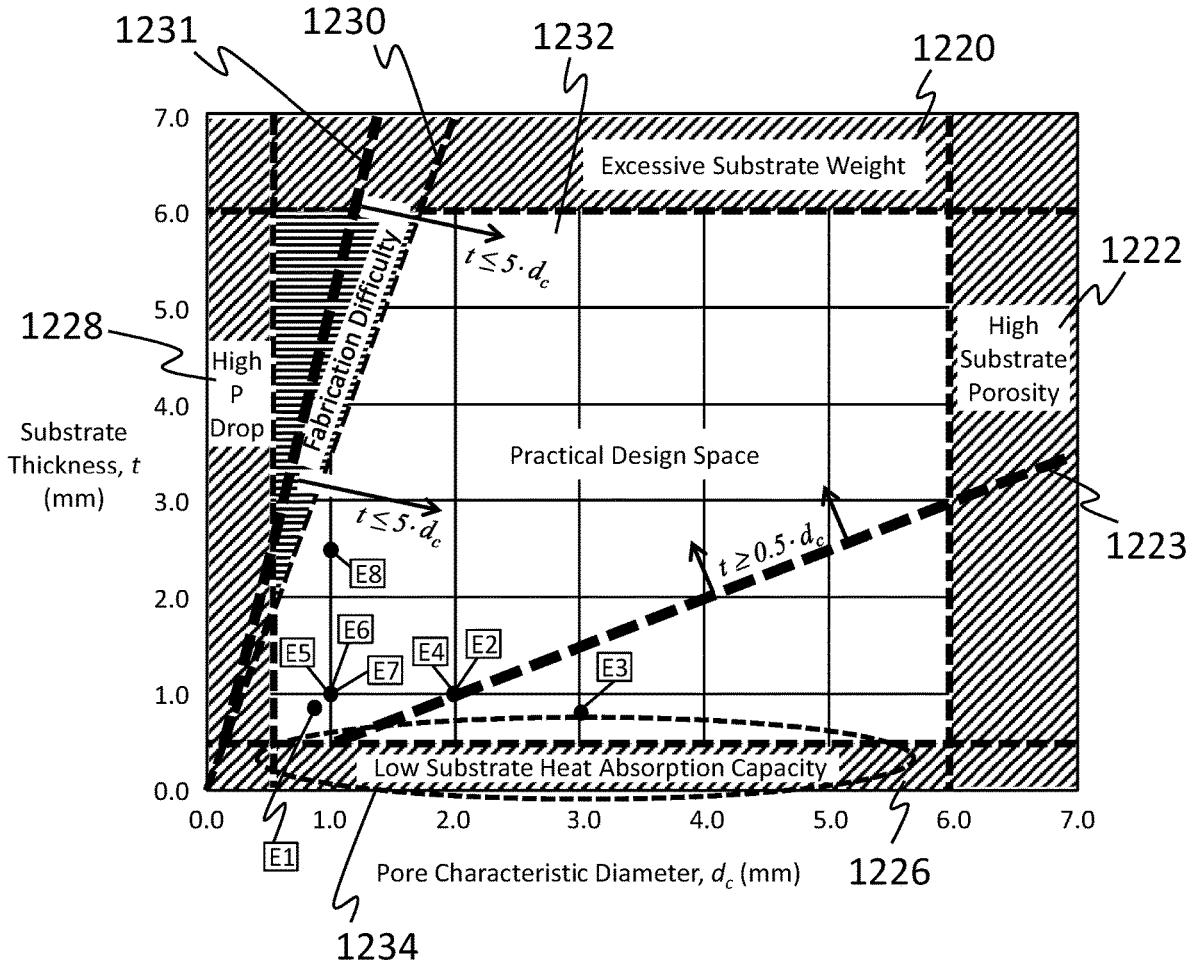
FIG. 12F shows a plot of empirical test results for various combinations of pore characteristic diameter and combustion substrate thickness in accordance with embodiments of the present disclosure.

As described above, all known solid combustion substrates utilize thin (approximately 0.5 millimeter) sheet metal materials over a range of pore characteristic diameters with various pore shapes, occupying a region 1234 of FIG. 12F where the substrate has little or no heat absorption capacity, in contrast to the flashback quenching exhibited by these empirical test results.

Figure 13:
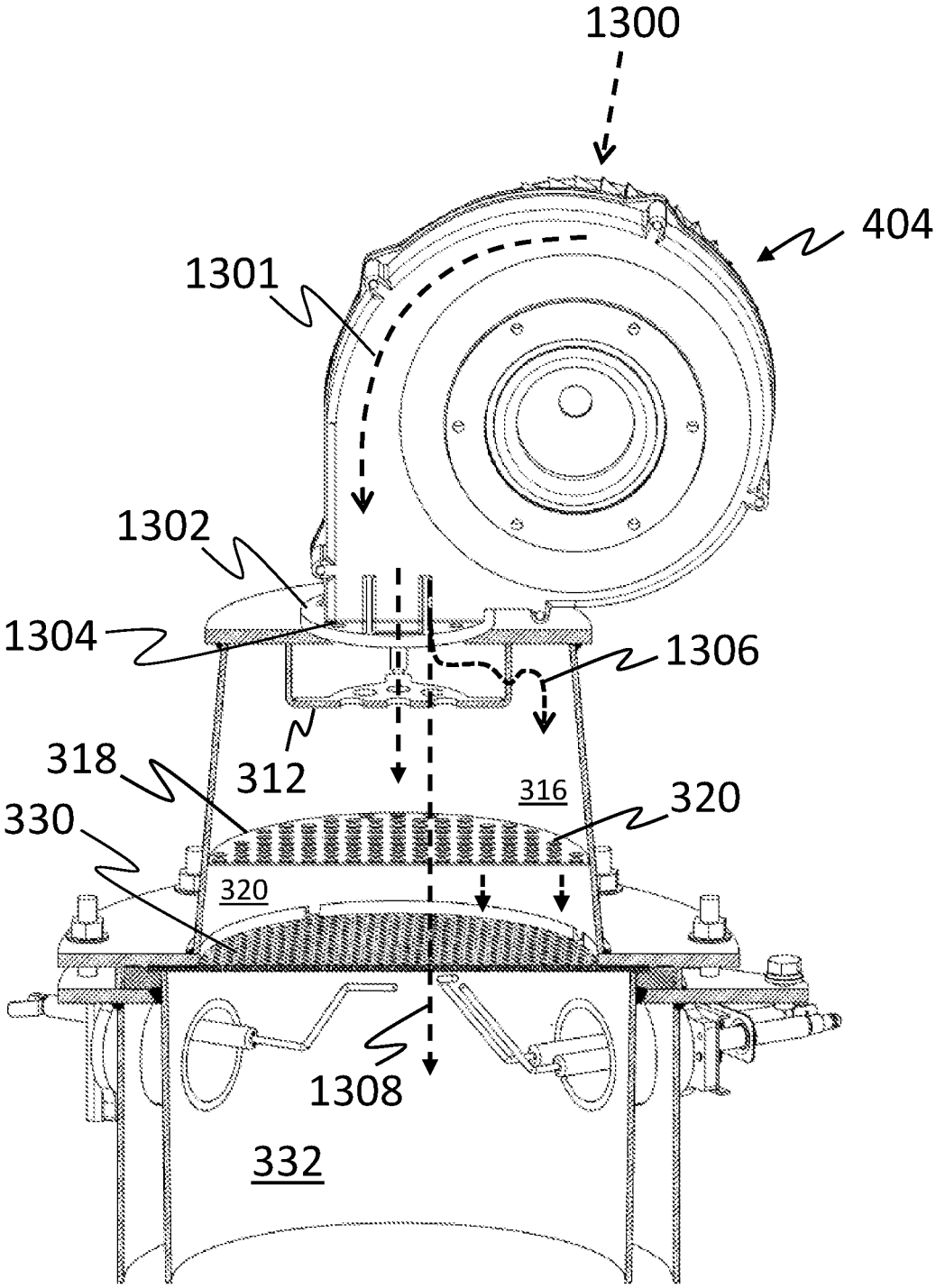
FIG. 13 shows a cross-sectional diagram of an embodiment comprising a burner with a flat substrate, distribution baffle, flow straightener and serviceable substrate mount with the blower attached in accordance with embodiments of the present disclosure.

FIG. 13 shows an embodiment comprising several of the elements and principles discussed above. Ambient air is drawn into the blower 404 and, under pressure 1301, is mixed with fuel and forced through the distribution baffle 312 (either through perforations or around the 1306 around the supports) into burner cavity 316, After passing through pores 321 in the flow straightener 318, the premix fuel-air mixture 1308 passes through the axial flow chamber 320 through the pores in the combustion substrate 330 and into the furnace chamber.

Figure 14:
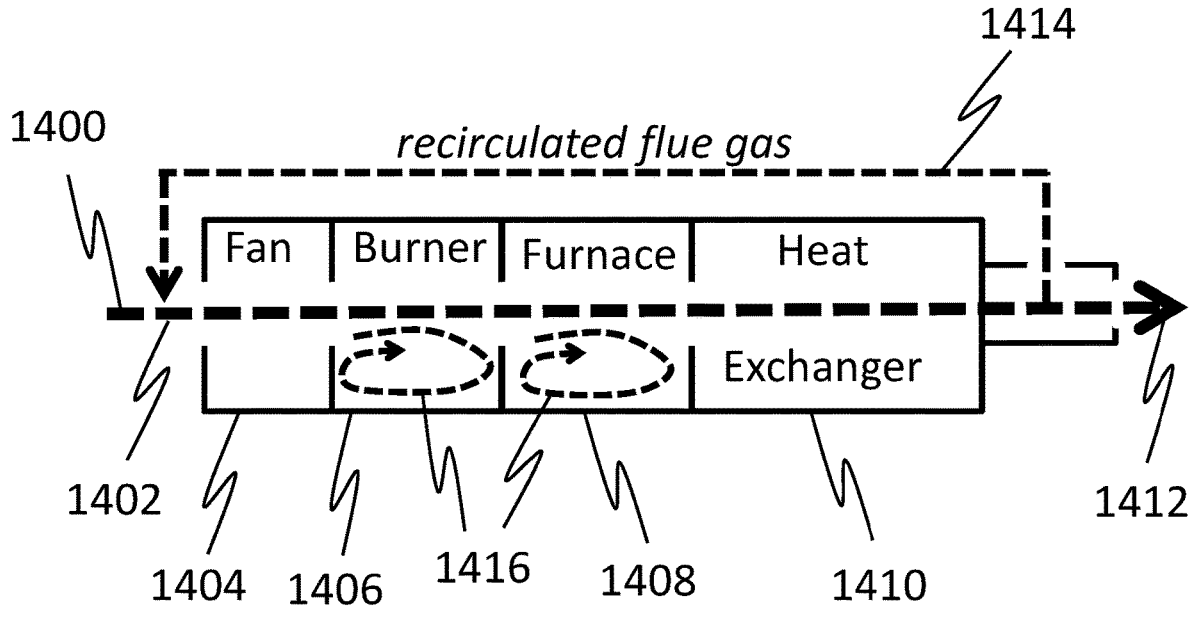
FIG. 14 shows a block diagram of the boiler combustion system and methods for creating combustion gas recirculation to reduce undesirable emissions in the exhaust stream in accordance with embodiments of the present disclosure.

FIG. 14 illustrates one benefit of the replaceable, serviceable combustion substrate with the substrate flange 600 described in FIG. 8A. Two ways that unwanted particulates and gaseous emissions can be reduced in the output of a combustion system involves combustion gas recirculation. The first involves directing flue gas 1414 from the output of the heat exchanger to the inlet of the fan (equivalently, blower), allowing a portion of the burner output to be re-combusted along with fresh premix. Thus, unburnt combustion byproducts (particulates, NOx) can be eliminated. However, the recirculation of flue gas into the blower inlet suffers from several disadvantages, notably that the reintroduction of hot flue gas into the blower degrades components of the blower and can significantly reduce the lifespan of the blower and burner.

A second method for the reduction of unburned byproducts in the burner exhaust is to design a recirculation zone 1416 within the burner and/or furnace that enables effective consumption of byproducts before the combustion gas leaves the furnace.

Figure 15:
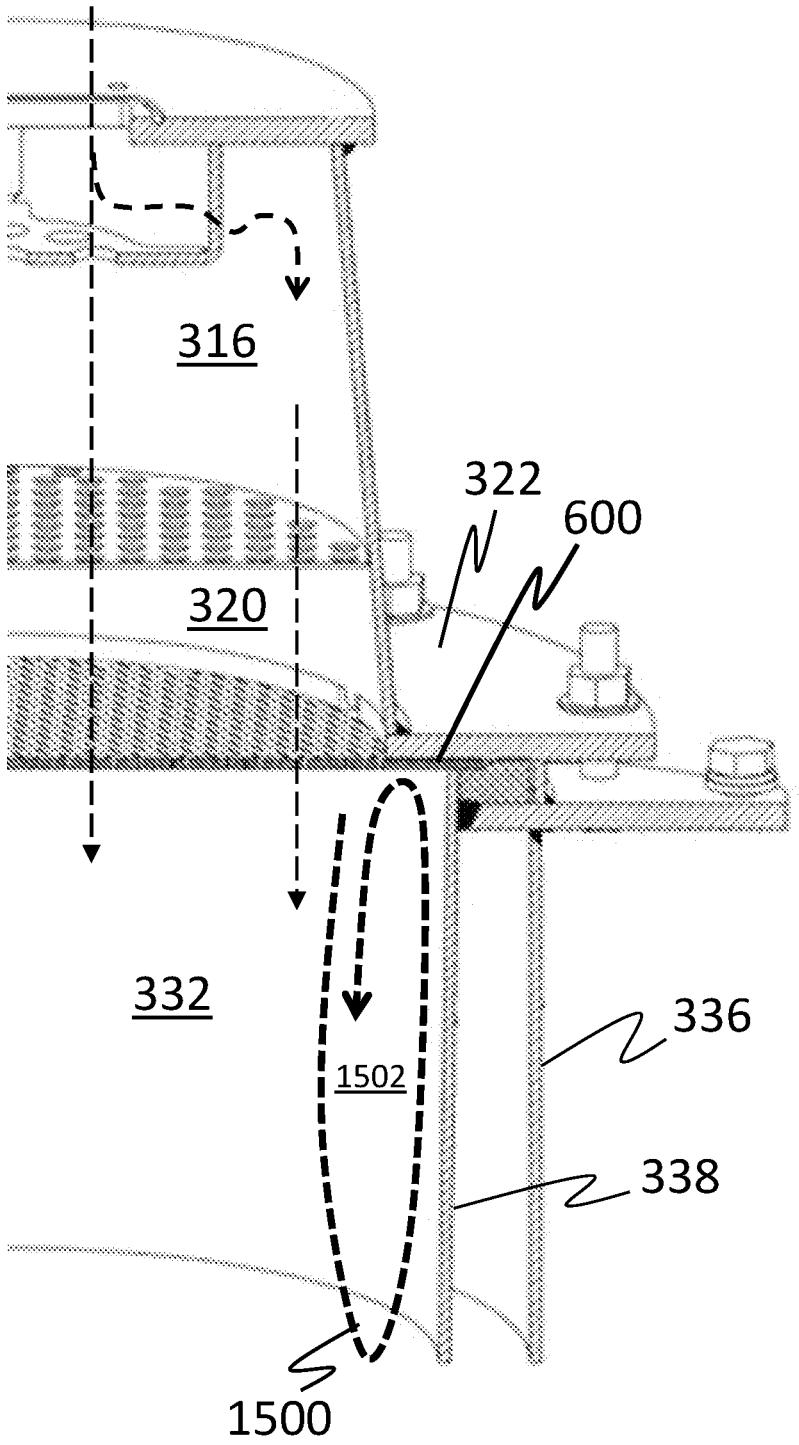
FIG. 15 shows the combustion gas recirculation zone generated by the combustion substrate mounting flange near the inner furnace wall in accordance with embodiments of the present disclosure.

FIG. 15 illustrates how the substrate flange can be designed to incorporate a recirculation zone into an embodiment that achieves lower emission performance. The combustion substrate flange 600 comprises a region of unperforated substrate near the inner furnace wall 338. By adjusting the width of the unperforated region, a region 1502 of combustion gas recirculation can be arranged that causes a portion of the flow to undergo re-combustion, thus reducing the discharge of undesirable particulates and incompletely consumed byproducts.

There are several important advantages to the arrangements in the disclosed embodiments. A first aspect is that the combustion substrate does not incorporate a mesh structure of woven fiber, steel or otherwise. Instead, a perforated substrate comprising pores is used to support combustion. Such a combustion substrate can support significantly higher combustion loading, is reliable, resistant to clogging, and does not require filter inlet air for the fuel-air premix.

A second aspect is that the combustion substrate can be removable, allowing for field maintenance and service of the burner unit deployed in the field. In one embodiment, flexible gaskets can be used to seal the combustion substrate in place sandwiched between the burner flange and the furnace flange or boiler top head ring. This implies that the burner may be serviced throughout the life of the boiler without requiring that the boiler be uninstalled and serviced by technicians at a specialized facility.

A third aspect is that the flexible mount for the combustion substrate permits the substrate mount to accommodate thermal expansion in the substrate, reducing thermal stress that would otherwise result from thermal cycling during the life of the burner. This compliance in the combustion substrate mount extends the life of the burner and furnace assembly, extending the mean time between failures for the assembly.

A fourth aspect is that the combustion substrate thickness—in conjunction with the pore dimension and other design parameters—can be used to control and inhibit burner flashback by conducting heat away from the pores, keeping the premix fuel-air mixture above its autoignition temperature, even when a flamelet encroaches on its supporting pore interior.

A fifth aspect is that the combustion substrate mounting flange can be used to create a recirculation zone within the furnace near the inner furnace wall. This recirculation zone promotes more complete combustion, reducing or eliminating particulate and gaseous combustion byproducts.

The various components of the premix fuel burner combustion system can each independently comprise any suitable material. Use of a metal is specifically mentioned. Representative metals include iron, aluminum, magnesium, titanium, nickel, cobalt, zinc, silver, copper, and an alloy comprising at least one of the foregoing. Representative metals include carbon steel, mild steel, cast iron, wrought iron, a stainless steel such as a 300 series stainless steel or a 400 series stainless steel, e.g., 304, 316, or 439 stainless steel, Monel, Inconel, bronze, and brass. Specifically mentioned is an embodiment in which the premix fuel burner combustion system components each comprise steel, specifically stainless steel. The premix burner combustion system may comprise a burner head, a combustion substrate, a baffle, a furnace wall that can each independently comprise any suitable material. Use of a steel, such as mild steel or stainless steel is mentioned. While not wanting to be bound by theory, it is understood that use of stainless steel in the dynamic components can help to keep the components below their respective fatigue limits, potentially eliminating fatigue failure as a failure mechanism, and promote efficient heat exchange.

The disclosed system can alternately comprise, consist of, or consist essentially of, any appropriate components herein disclosed. The disclosed system can additionally be substantially free of any components or materials used in the prior art that are not necessary to the achievement of the function and/or objectives of the present disclosure.

The terms "a" and "an" do not denote a limitation of quantity, but rather denote the presence of at least one of the referenced item. The term "or" means "and/or" unless clearly indicated otherwise by context. Reference throughout the specification to "an embodiment", "another embodiment", "some embodiments", and so forth, means that a particular element (e.g., feature, structure, step, or characteristic) described in connection with the embodiment is included in at least one embodiment described herein, and may or may not be present in other embodiments. In addition, it is to be understood that the described elements may be combined in any suitable manner in the various embodiments. "Optional" or "optionally" means that the subsequently described event or circumstance may or may not occur, and that the description includes instances where the event occurs and instances where it does not. The terms "first," "second," and the like, "primary," "secondary," and the like, as used herein do not denote any order, quantity, or importance, but rather are used to distinguish one element from another. The terms "front", "back", "bottom", and/or "top" are used herein, unless otherwise noted, merely for convenience of description, and are not limited to any one position or spatial orientation.

The endpoints of all ranges directed to the same component or property are inclusive of the endpoints, are independently combinable, and include all intermediate points. For example, ranges of "up to 25 N/m, or more specifically 5 to 20 N/m" are inclusive of the endpoints and all intermediate values of the ranges of "5 to 25 N/m," such as 10 to 23 N/m.

Unless defined otherwise, technical and scientific terms used herein have the same meaning as is commonly understood by one of skill in the art to which this invention belongs.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

What is claimed is:

1. A pre-mix combustion burner, comprising:

a burner casing configured to receive a fuel-air mixture at a burner inlet and to provide hot combustion gas at a burner output;

a combustion substrate disposed within the burner casing, the substrate having a shape comprising a flat plate having a substrate porosity defined by a plurality of pores, and having a substrate inner surface and a substrate outer surface;

the substrate configured to receive the fuel-air mixture at the outer surface of the substrate, the fuel-air mixture passing through the pores at a mixture flow rate from the substrate outer surface toward the substrate inner surface;

a fan having a fan speed which forces the premix fuel-air through at least one pore and provides a predetermined pressure drop across a pore of the substrate, and wherein a substrate thickness, t, and at least one pore characteristic diameter, $d_c$, are set such that the substrate inhibits flashback by conducting heat through the pore walls of the substrate sufficiently to ensure premix fuel-air in the pore remains below its autoignition temperature, for a predetermined substrate material, fan speed and substrate porosity;

the burner configured such that, in operation, the fuel-air mixture ignites near the plurality of pores to form a respective plurality of flamelets, each flamelet corresponding to one of the pores.

2. The burner of claim 1 wherein the relationship between a substrate thickness, t, and at least one pore characteristics diameter, $d_c$, is constrained by $0.5 \leq t/d_c \leq 5$.

3. The burner of claim 1 wherein at least one pore characteristic diameter, $d_c$, is less than or equal to 6 millimeters.

4. The burner of claim 1 wherein at least one pore characteristic diameter, $d_c$, is greater than or equal to 0.5 millimeters.

5. The burner of claim 1 wherein a substrate thickness, t, is less than or equal to 6 millimeters.

6. The burner of claim 1 wherein a substrate thickness, t, is greater than or equal to 0.5 millimeters.

7. The burner of claim 1 wherein the porosity is set such that a flame equilibrium ratio, $\rho$, balances the force due to the premix fuel flow through the pore and the opposing force due to the reaction zone for $1<\rho<100$.

8. The burner of claim 1, wherein the plurality of flamelets provides a substantially uniform temperature distribution across the substrate inner surface and provides a substantially uniform flow field distribution of the hot combustion gas at the burner output.

9. The burner of claim 1, wherein the pores have a shape comprising at least one of: circular, elliptical, elongated, slot, square, rectangular, symmetrical shape, and asymmetrical shape.

10. Burner of claim 9, wherein the shape of at least one pore is an approximately circular of maximum diameter between about 0.5 millimeters and about 6 millimeters.

11. Burner of claim 9, wherein the shape of at least one pore is approximately a slot with width between about 0.5 millimeters and about 4 millimeters and length between about 2 millimeters and about 15 millimeters.

12. Burner of claim 9, wherein the depth of at least one pore is approximately 0.5 millimeter to 1 centimeter.

13. Burner of claim 9, wherein the depth of at least one pore is greater than one half (0.5) the characteristic diameter of the pore and less than five times the characteristic diameter of the pore.

14. The burner of claim 1, further comprising a baffle, disposed between the substrate and the burner casing, and arranged to receive the fuel-air mixture.

15. The burner of claim 1, further comprising an ignitor disposed on an inner side of the substrate where combustion occurs.

16. The burner of claim 1, further comprising a removable and serviceable combustion substrate mounting assembly.

17. The burner of claim 1, further comprising a combustion substrate mounting assembly with a compliant element that allows thermal expansion and contraction of the combustion substrate.

18. The burner of claim 1, wherein at least one combustion substrate pore inhibits flashback by conducting heat through the pore walls of the substrate sufficiently to ensure premix fuel-air in the pore remains below its autoignition temperature.

19. The burner of claim 1, further comprising a combustion substrate flange which creates a combustion gas recirculation zone near a furnace wall.

20. The burner of claim 1 wherein the at least one pore characteristic diameter, $d_c$, and the substrate thickness, t, have values such that there is an average pore quenching time which maintains the temperature of the fuel entering the pore below the fuel autoignition temperature.

21. The burner of claim 1 wherein a substrate thickness, t, and at least one pore characteristic diameter, $d_c$, are set such that $t/d_c$ is approximately greater than or equal to 0.5, which results in a practical operating condition of less than a quenching boundary.

22. The burner of claim 1 wherein a substrate thickness, t, and at least one pore characteristic diameter, $d_c$, are set such that $t/d_c$ is approximately greater than or equal to 0.5, which results in a practical operating condition of greater than a rejection boundary.

23. The burner of claim 1 wherein a substrate thickness, t, and at least one pore characteristic diameter, $d_c$, are set such that $t/d_c$ is approximately greater than or equal to 0.5, which results in a practical operating condition between a quenching boundary and a rejection boundary.

24. The burner of claim 1 wherein a substrate thickness, t, and at least one pore characteristic diameter, $d_c$, are set to have an average quenching time between a quenching boundary and a rejection boundary.

25. The burner of claim 1, wherein the substrate inhibits flashback by conducting heat through the pore walls of the substrate sufficiently to ensure premix fuel-air in the pore remains below its autoignition temperature.

26. The burner of claim 1, wherein the substrate is made of a material having a thermal conductivity together with a substrate thickness, t, and at least one pore characteristic diameter, $d_c$, such that the substrate inhibits flashback by conducting heat through the pore walls of the substrate sufficiently to ensure premix fuel-air in the pore remains below its autoignition temperature.

27. A premix combustion burner, comprising:

a burner casing configured to receive a fuel-air mixture at a burner inlet and to provide hot combustion gas at a burner output;

a solid combustion substrate disposed within the burner casing, the substrate having a shape comprising at flat surface, having a substrate porosity defined by a plurality of pores, and having a substrate inner surface and a substrate outer surface;

the substrate configured to receive the fuel-air mixture at the outer surface of the substrate, the fuel-air mixture passing through the pores at a mixture flow rate from the substrate outer surface toward the substrate inner surface;

a fan having a fan speed which forces the premix fuel-air through at least one pore and provides a predetermined pressure drop across a pore of the substrate, and wherein a substrate thickness, t, and at least one pore characteristic diameter, $d_c$, are set such that the substrate inhibits flashback by conducting heat through the pore walls of the substrate sufficiently to ensure premix fuel-air in the pore remains below its autoignition temperature, for a predetermined substrate material, fan speed and substrate porosity;

the burner configured such that, in operation, the fuel-air mixture ignites near the plurality of pores to form a respective plurality of flamelets, each flamelet corresponding to one of the pores; and wherein the substrate inhibits flashback by conducting heat through walls of the pores sufficiently to ensure premix fuel-air in the pore remains below its autoignition temperature.

28. A premix combustion burner, comprising:

a burner casing configured to receive a fuel-air mixture at a burner inlet and to provide hot combustion gas at a burner output;

a combustion substrate disposed within the burner casing, the substrate having a shape comprising at flat surface, having a substrate thickness, t, and at least one pore characteristic diameter, $d_c$, having a substrate porosity defined by a plurality of pores, and having a substrate inner surface and a substrate outer surface, and the substrate made of a substrate material having a predetermined thermal conductivity;

the substrate configured to receive the fuel-air mixture at the outer surface of the substrate, the fuel-air mixture passing through the pores at a mixture flow rate from the substrate outer surface toward the substrate inner surface;

the burner configured such that, in operation, the fuel-air mixture ignites near the plurality of pores to form a respective plurality of flamelets, each flamelet corresponding to one of the pores;

a blower fan having a predetermined fan speed configured to force the fuel-air mixture through the pores; and wherein the substrate thickness t and characteristic diameter $d_c$, are set such that the substrate inhibits flashback by conducting heat through walls of the pores sufficiently to ensure premix fuel-air in the pore remains below its autoignition temperature, for a predetermined substrate material, fan speed and substrate porosity.

* * * * *